US006316161B1

(12) United States Patent
Obayashi et al.

(10) Patent No.: US 6,316,161 B1
(45) Date of Patent: Nov. 13, 2001

(54) IMAGE RECORDING MEDIUM COMPRISING COMPOUND GENERATING ACID BY ACTION OF HEAT, ACID OR LIGHT

(75) Inventors: Tatsuhiko Obayashi; Tatsuya Igarashi; Atsuhiro Ohkawa, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/388,551

(22) Filed: Sep. 2, 1999

(30) Foreign Application Priority Data

Sep. 3, 1998 (JP) ..... 10-250051

(51) Int. Cl.[7] ..... G03C 1/492; G03C 1/73

(52) U.S. Cl. ..... 430/280.1; 430/292; 430/270.11; 430/944; 430/945; 522/151; 522/152; 522/35

(58) Field of Search ..... 430/270.11, 280.1, 430/292, 945, 944; 522/35, 151, 152

(56) References Cited

U.S. PATENT DOCUMENTS 5,453,345 * 9/1995 Grasshoff et al. ..... 430/270.1
5,914,213 * 6/1999 Grasshoff et al. ..... 430/270.1
6,100,009 * 8/2000 Obayashi et al. ..... 430/270.1

FOREIGN PATENT DOCUMENTS 0 909 656 A2 4/1999 (EP) ..... B41M/5/36
8-248561 * 9/1996 (JP) .

* cited by examiner

*Primary Examiner*—Martin Angebranndt
(74) *Attorney, Agent, or Firm*—Sughrue, Mion, Zinn, Macpeak & Seas, PLLC

(57) ABSTRACT

Disclosed is an image recording medium which comprises a compound having at least one substituent group removable by the action of heat, an acid or light and capable of producing an acid by an intramolecular nucleophilic substitution subsequent to the removal of the substituent group to acquire both high sensitivity and excellent storage quality.

5 Claims, No Drawings

IMAGE RECORDING MEDIUM COMPRISING COMPOUND GENERATING ACID BY ACTION OF HEAT, ACID OR LIGHT

FIELD OF THE INVENTION

The present invention relates to a highly sensitive image recording medium of chemical amplification type, which comprises a compound capable of generating an acid by the action of heat, an acid or light.

BACKGROUND OF THE INVENTION

In heat-sensitive recording materials, the image and non-image areas are represented as the distribution of temperature difference. For visualization of this distribution have been devised various methods utilizing, e.g., fusion or sublimation transfer of coloring materials, coloring reaction between two components by hot fusion or destruction of capsules, and changes in optical characteristics by phase transition. The heat recording materials of this kind can provide recorded images in a dry process using a simple system, and have an advantage of requiring no maintenance. Therefore, they have been widely used as output materials of various kinds of printers, word processors, facsimile and so on. Further, with the recent much progress in laser recording apparatus, the application of the aforesaid heat recording materials to optical disks and platemaking materials for photomechanical process has been examined.

Hitherto, silver halide photosensitive materials requiring wet processing operations have been employed as platemaking materials. In view of requirements for simplifying processing steps and problems of environmental pollution by processing solutions, however, the development of dry processes has been desired, and some technological proposals on heat-sensitive recording methods have been produced recently. In particular, the recording of images by laser beams is advantageous from the viewpoint of resolution. For instance, the system referred to as dye ablation utilizing high output laser has been developed. The recording materials for such a system are disclosed in JP-A-7-164755, JP-A-7-149063 and JP-A-7-149065, and the image forming devices therefor are disclosed in JP-A-8-48053 and JP-A-8-72400 (the term "JP-A" as used herein means an "unexamined published Japanese patent application").

In such a system is used a recording material having a support coated with a dye composition comprising an image dye, a substance having its absorption in the wavelength region of laser (an infrared absorbing substance) and a binder, and an image is recorded on the recording material by irradiation with a laser beam from the dye coating side. When a laser beam strikes a spot on the recording material, the image forming layer corresponding to the spot undergoes an abrupt local change due to the energy conferred thereon by the laser beam, and thereby the substances are expelled out of the layer. According to the references cited above, the change caused therein is not a perfectly physical change (e.g., fusion, evaporation or sublimation), but a certain chemical change (e.g., bond rupture), and thereby the image dye is removed perfectly but not partially. The dye ablation system as mentioned above has disadvantages in that high output laser is indispensable in order to elevate the efficiency of dye removal at the spot struck by a laser beam and it is required to have a dust catcher installed in order to collect the dye removed.

With respect to the system requiring no dust catcher, U.S. Pat. No. 5,171,650 discloses the image recording method of ablation transfer type wherein laser is used as heat source. In this system, a dye donor sheet having a dynamic release layer provided with the topcoat of an ablative carrier is used, and the image is transferred onto a separate dye-receiving sheet placed so as to adjoin the dye donor sheet and be in a proper position. Therefore, this system has a drawback that the donor sheet useless after image recording must be disposed of as a waste. For this system also, high output laser is indispensable in order to heighten the transfer efficiency. Accordingly, the hitherto known heat-sensitive recording systems utilizing the ablation by laser have problems that they require high output laser and the generation of dust and waste can hardly be avoided.

As another laser-utilized system of heat-sensitive recording, although no ablation accompanies the recording, JP-A-6-194781 discloses a system into which the system referred to as "dry silver" is developed. In this system, the recording with laser is performed on a recording material comprising a silver source capable of being reduced thermally, a silver ion reducing agent and a photothermic conversion dye. However, this system is practically insufficient in storability of non-image area and heat sensitivity.

As for the other laser-utilized heat-sensitive recording systems, the compounds changing their absorption by pyrolysis of carbamates are disclosed in U.S. Pat. Nos. 4,602,263 and 4,826,976, and the compounds developing yellow color by the pyrolysis of t-butoxycarbonyl group introduced to the hydroxyl groups therein are disclosed in U.S. Pat. No. 5,243,052. Those recording. systems utilize an irreversible monomolecular reaction, and are suitable for very short-time recording of images by the use of laser. However, they are insufficient in sensitivity, so that it has been expected to increase their sensitivities.

As a means to elevate the photosensitive speed of photoresist by leaps and bounds, on the other hand, the compounds embodying a new concept that an acid catalyst is multiplied by the action of an acid catalyst are disclosed in JP-A-8-248561. The acid-multiplied compounds described in this reference include the compounds producing organic acids by electron transfer subsequent to the decomposition of t-butyl esters or the like by an acid catalyst, the compounds producing organic acids by B-elimination subsequent to the acid catalytic decomposition of acetals or ketals, and the compounds producing organic acids by pinacol rearrangement in the presence of an acid catalyst.

By combining these compounds each with a compound changing its absorption characteristics by the action of an acid, highly sensitive color image-forming recording materials can be obtained. Further, such compounds have a function as an acid generator, and generate acids by the action of heat at the time of recording images in laser heat mode. Therein, it is unnecessary to add other special acid generators.

However, those compounds are practically insufficient to ensure both sensitivity and storage stability for the recording materials of color image formation type. Further, they generate stain or gas upon decomposition. Therefore, it will be necessary to introduce improvements in those compounds if their application to the recording materials of color image formation type is intended. In addition, it is not so easy to synthesize those acid multipliers, so that further improvement is required for them in this respect also.

Additionally, 1-methanesulfonyloxy-5-(α-tetrahydropyranyl)oxypentane, which is included in the structures of acid generators according to the present invention, is described in *Journal of Organic Chemistry,* vol.

53, pp. 318–327. Therein, however, that compound is described simply as a synthesis intermediate of 5-[(α-tetrahydropyranyl)oxy]-1-iodopentane, and the application of the compound as an acid generator to image recording media is mentioned nowhere.

SUMMARY OF THE INVENTION

A first object of the present invention is to provide an image recording medium having both high activity and excellent storability by incorporating therein a novel acid generator of intramolecular nucleophilic substitution type which, though stable upon storage, can generate an acid by the action of heat or an acid.

A second object of the present invention is to provide an image recording medium having both excellent storability and high activity by incorporating therein an acid generator of intramolecular nucleophilic substitution type which can generate an acid by the action of light.

The aforementioned objects of the present invention are attained with the following embodiments 1) to 5):

1) An image recording medium comprising a compound that has at least one substituent group removable by the action of heat, an acid or light and can produce an acid by an intramolecular nucleophilic substitution subsequent to the removal of the substituent group.

2) An image recording medium as described in the embodiment 1), wherein said compound is a compound represented by the following formula (1):

$$P—X—L—C(R^1)(R^2)—OA \quad (i)$$

wherein P represents a substituent group removable by the action of heat, an acid or light; X represents O, S, $N(R^3)$ or $C(R^4)(R^5)$; $R^3$ is a hydrogen atom or a group capable of substituting therefor; $R^4$ and $R^5$, which may be the same or different, are each a hydrogen atom or a group capable of substituting therefor; L represents a linkage group; $R^1$ and $R^2$, which may be the same or different, are each a hydrogen atom or a group capable of substituting therefor; and OA represents the residue of an acid represented by HOA.

3) An image recording medium as described in the embodiment 1) or 2), further comprising a compound that can produce a change in the absorption region of 360–900 nm through the intramolecular or intermolecular reaction caused therein by the action of the acid.

4) An image recording medium as described in the embodiment 1), 2) or 3), further comprising a compound that can generate an acid by the action of light or heat.

5) An image recording medium as described in the embodiment 1), 2), 3) or 4), further comprising an infrared absorbing substance.

DETAILED DESCRIPTION OF THE INVENTION

The present invention is described below in greater detail.

The compounds used in the present invention as compound capable of generating an acid by the action of heat, an acid or light are compounds which each have at least one substituent group removable by the action of heat, an acid or light and can generate an acid through the intramolecular nucleophilic substitution subsequent to the removal of the aforesaid substituent group. When the above substituent group is removed by the action of an acid, a small amount of acid once produced proceeds the reaction to increase the quantity of acid produced, and thereby the reaction is further accelerated.

The substituent group removable by the action of heat, an acid or light (hereinafter referred to as the substituent P) is introduced into a nucleophilic group, such as a hydroxyl group, a mercapto group, an amino group or a carbon atom, and hinders the intramolecular nucleophilic substitution from occurring upon storage or in the non-image area. In the image area, however, the substituent P is decomposed and eliminated by the action of heat, an acid or light to enable the generation of an acid through the intramolecular nucleophilic substitution.

Suitable examples of a substituent group P, which can be removed by the action of heat or an acid, introduced to the oxygen atom include alkoxycarbonyl groups (e.g., t-butoxycarbonyl, isopropyl-oxycarbonyl, 1-phenylethoxycarbonyl, 1,1-diphenylethoxycarbonyl, 2-cyclohexeneoxycarbonyl), alkoxymethyl groups (e.g., methoxymethyl, ethoxy-methyl, n-octyloxymethyl, tetrahydropyranyl, tetrahydro-furanyl, 4,5-dihydro-2-methylfuran-5-yl), silyl groups (e.g., trimethylsilyl, triethylsilyl, t-butyldimethylsilyl, t-butyldiphenylsilyl, phenyldimethylsilyl) and secondarty or tertiary alkyl groups having a hydrogen atom at the β-position (e.g., t-butyl, 2-cyclohexenyl). Suitable examples of the substituent P introduced to the sulfur atom include alkoxymethyl groups (e.g., isobutoxymethyl, tetrahydro-pyranyl), alkoxycarbonyl groups (e.g., benzyloxycarbonyl, p-methoxybenzyloxycarbonyl), acyl groups (e.g., acetoxy, benzoyl) and benzyl groups (e.g., p-methoxybenzyl, bis(4-methoxyphenyl)methyl, triphenylmethyl). Suitable examples of the substituent P introduced to the nitrogen atom include alkoxycarbonyl groups (e.g., t-butoxycarbonyl, cyclohexyloxycarbonyl, 2-(2-methyl) butoxycarbonyl, 2-(2-phenyl)propyloxycarbonyl, 2-chloroethoxycarbonyl), acyl groups (e.g., acetyl, benzoyl, 2-nitrobenzoyl, 4-chlorobenzolyl, 1-naphthoyl) and a formyl group. Suitable examples of the substituent P introduced to the carbon atom include tertiary alkoxycarbonyl groups (e.g., t-butoxycarbonyl).

Suitable examples of a substituent P, which can be removed by the action of light, introduced to the oxygen atom and the sulfur atom include nitrobenzyl group, dinitrobenzyl group, nitrobenzyloxycarbonyl group and nitrobenzyloxymethyl group. Suitable examples of the substituent P introduced to the nitrogen atom include nitrobenzyloxycarbonyl group, nitrobenzyloxymethyl group and formyl group. Suitable examples of the substituent P introduced to the carbon atom include nitrobenzyloxycarbonyl group and nitrobenzyloxymethyl group.

It is desirable for the present compound to have a structure forming a 5- to 10-membered ring, particularly preferably from a 5- or 6-membered ring, in the intramolecular nucleophilic substitution subsequent to the removal of such a substituent P as recited above.

The acid produced by the intramolecular nucleophilic substitution is preferably an acid having pKa less than 3, with suitable examples including sulfonic acids (e.g., p-toluenesulfonic acid, benzenesulfonic acid, methanesulfonic acid, trifluoromethanesulfonic acid), carboxylic acids (e.g., p-nitrobenzoic acid, 2-chloro-4-nitrobenzoic acid, trifluoroacetic acid, trichloroacetic acid), phosphinic acids (e.g., phenylphosphinic acid, p-nitrophenylphosphinic acid, diiphenylphosphinic acid) and phosphonic acids (e.g., phenylphosphonic acid, ethylphosphonic acid).

The compound capable of generating an acid by the action of heat, an acid or light which is used in the present invention (hereinafter referred to as the present acid generator) may form a polymer by introducing a polymerizing group at the position permitting substitution and linking the polymerizing groups to one another. When the present acid generator is applied to an image recording medium utilizing a change caused in hue by the action of acid, which is mentioned hereinafter, the ability to form a coating can be conferred on the recording material without using a special binder so far as the present acid generator forms a polymer. Therefore, it is favorable for reduction in thickness of the image recording layer to let the present acid generator have the form of a polymer. The suitable molecular weight of the polymer is from $10^3$ to $10^6$, particularly preferably from $2\times10^3$ to $3\times10^5$. In this case, the polymer may be either homopolymer of the present acid generator or a copolymer with other monomers.

By copolymerizing the present acid generator and a compound capable of developing a color or being decolorized by the action of an acid, which is described hereinafter, it can be expected to increase the sensitivity in a sense of generating an acid in the close vicinity of a leuco dye or the like. The suitable ratio of the leuco dye part to the acid generator part in such a copolymer is from 100/1 to 1/20, particularly preferably from 20/1 to 1/5.

For the intramolecular nucleophilic substitution type acid generator used in the present image recording medium, it is especially desirable to have a structure of formula (1).

In the formula (1), P represents a substituent group capable of decomposing and being eliminated by the action of heat, an acid or light, and has the same meaning as the aforementioned substituent P. Suitable examples of P include the same ones as recited above.

L in formula (1) represents a linkage group, preferably a group connecting X to C the shortest chain of which is constituted of 3 to 8 atoms, especially 3 or 4 atoms. Suitable examples of such atoms include carbon (which may have a substituent group), oxygen, sulfur and nitrogen (which may have a substituent group) atoms. The substituent groups in such a linkage group may combine with each other to form a ring.

$R^1$ and $R^2$ in formula (1) may be the same or different, and each of them represents a hydrogen atom or a substituent group. Suitable examples of a substituent group as $R^1$ and $R^2$ each include alkyl groups (including substituted ones, and preferably containing 1 to 60 carbon atoms, such as methyl, ethyl, n-propyl and trifluoromethyl groups), and aryl groups (including substituted ones, and preferably containing 6 to 60 carbon atoms, such as phenyl, naphthyl, p-methoxyphenyl and p-chlorophenyl groups) . In particular, it is desirable for both of them to be a hydrogen atom.

X in formula (1) represents O, S, $N(R^3)$ (wherein $R^3$ is a hydrogen atom or a group capable of substituting therefor, with examples including those recited above as $R^1$ and $R^2$) or $C(R^4)(R^5)$ (wherein $R^4$ and $R^5$ may be the same or different, and each of them represents a hydrogen atom or a group capable of substituting therefor, with examples including those recited above as $R^1$ and $R^2$), preferably O or S, particularly preferably O.

OA in formula (1) represents the residue of an acid represented by HOA. Suitable examples of HOA include the same ones as recited above with respect to the acid produced by an intramolecular nucleophilic substitution.

The acid generation efficiency of a compound represented by formula (1) can be controlled by properly selecting the substituent P, the linkage group L and the pKa of an acid generated (AOH).

Examples of a compound useful for the present invention, which can generate an acid by the action of heat or an acid, are illustrated below, but it should be understood that these examples are not to be construed as limiting the scope of the invention in any way.

A-(1)

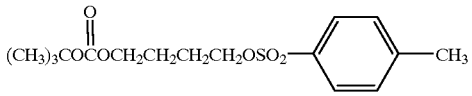

A-(2)

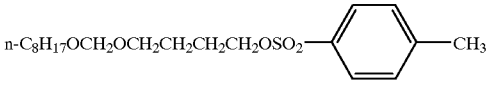

A-(3)

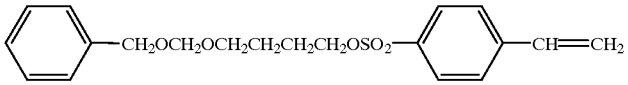

A-(4)

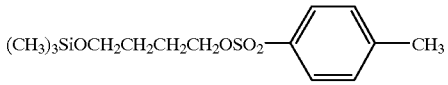

A-(5)

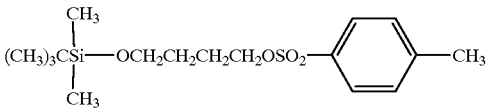

-continued
A-(6)
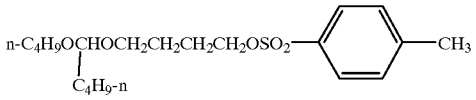
A-(7)
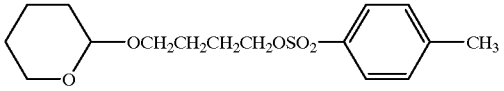
A-(8)
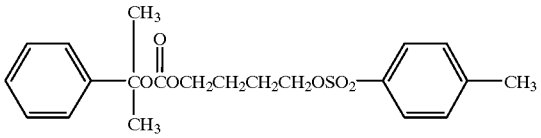
A-(9)
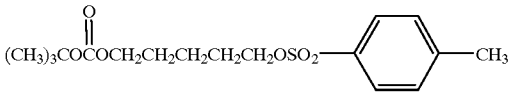
A-(10)
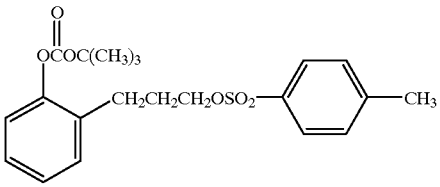
A-(11)
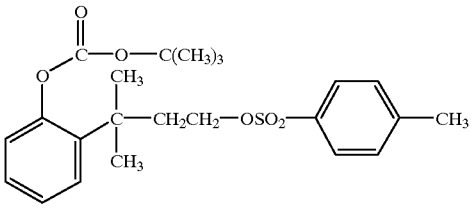
A-(12)
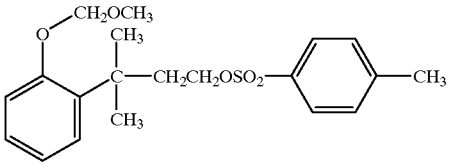
A-(13)
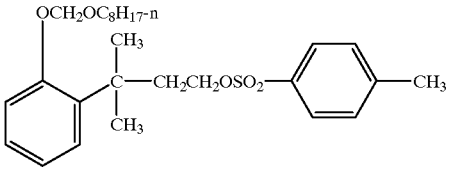
A-(14)
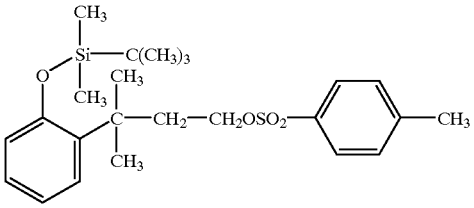

-continued
A-(15)
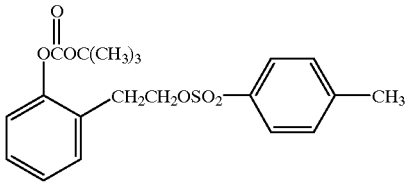
A-(16)
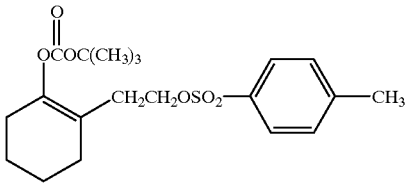
A-(17)
$n\text{-}C_8H_{17}OCH_2OCH_2CH_2CH_2CH_2OSO_2CF_3$
A-(18)
$n\text{-}C_8H_{17}OCH_2OCH_2CH_2CH_2CH_2OSO_2CH_3$
A-(19)
$n\text{-}C_8H_{17}OCH_2OCH_2CH_2CH_2CH_2OSO_2C_{12}H_{25}\text{-}n$
A-(20)
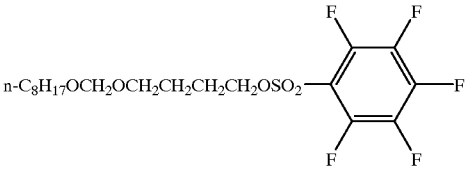
A-(21)
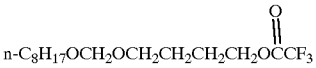
A-(22)
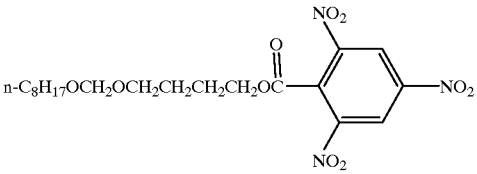
A-(23)
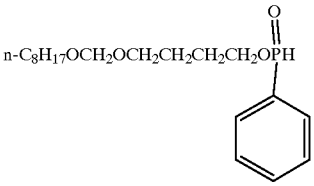
A-(24)
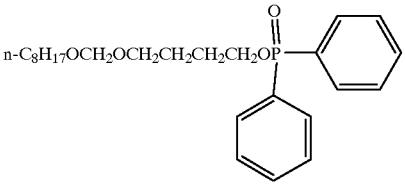

-continued
A-(25)
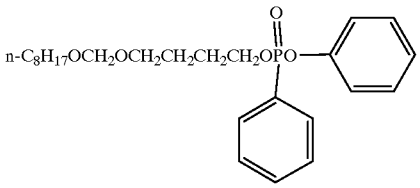
A-(26)
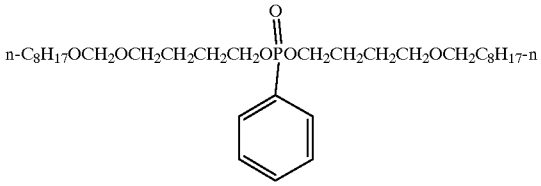
A-(27)
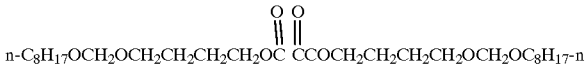
A-(28)
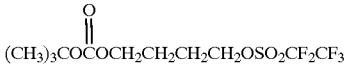
A-(29)
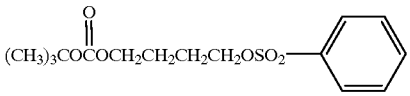
A-(30)
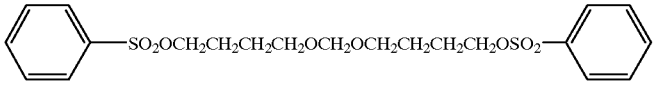
A-(31)
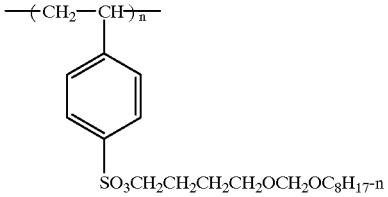
n = 100
A-(32)
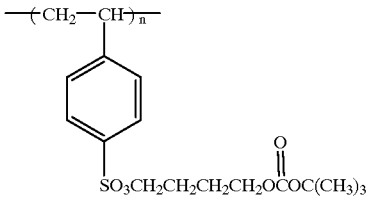
n = 100
A-(33)
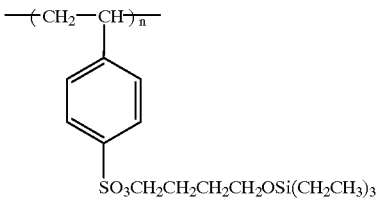
n = 100

-continued
A-(34)
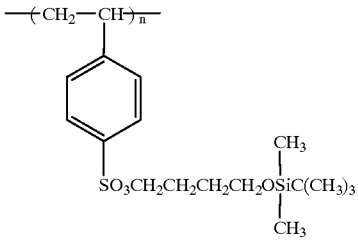
n = 100
A-(35)
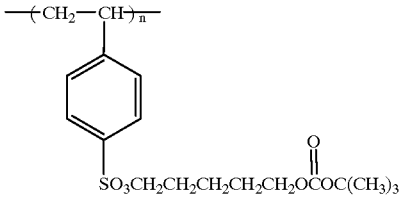
n = 100
A-(36)
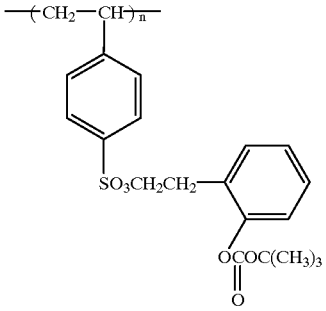
n = 100
A-(37)
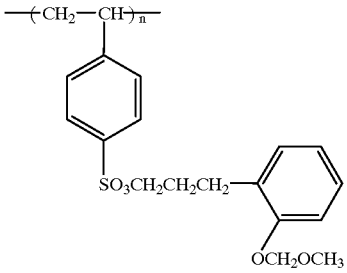
n = 100
A-(38)
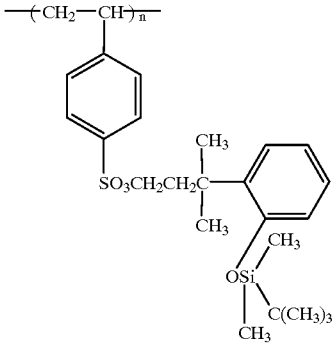
n = 100

-continued
A-(39)
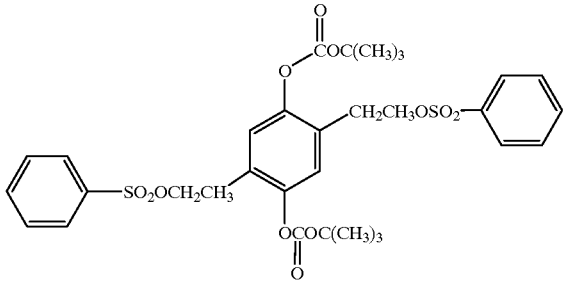
A-(40)
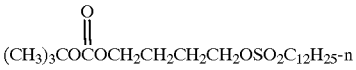
A-(41)
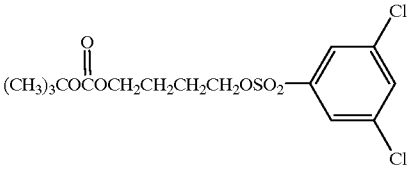
A-(42)
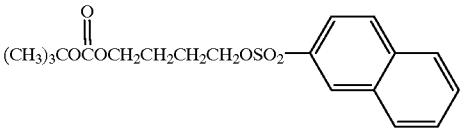
A-(43)
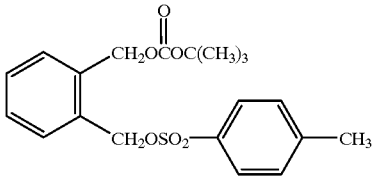
A-(44)
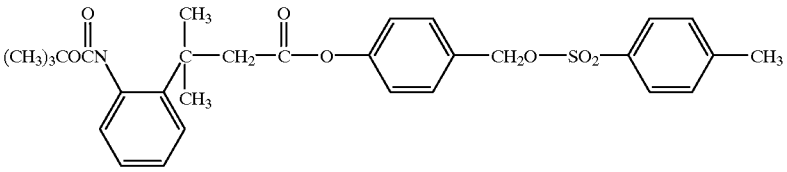
A-(45)
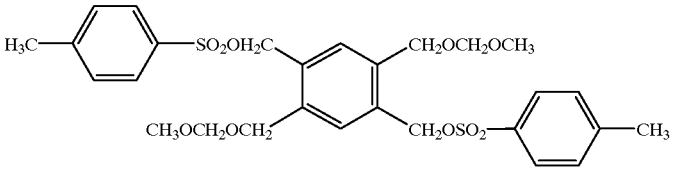
A-(46)
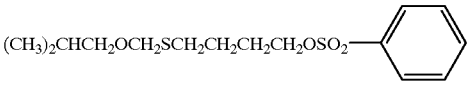
A-(47)
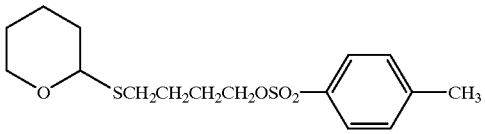

-continued
A-(48)
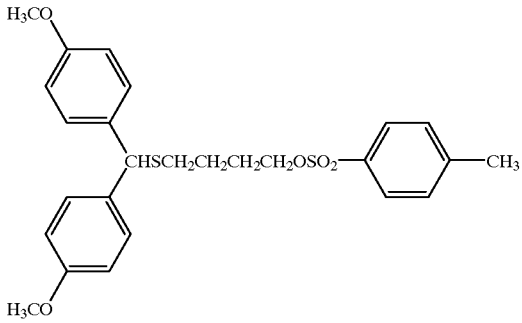
A-(49)
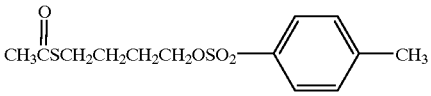
A-(50)
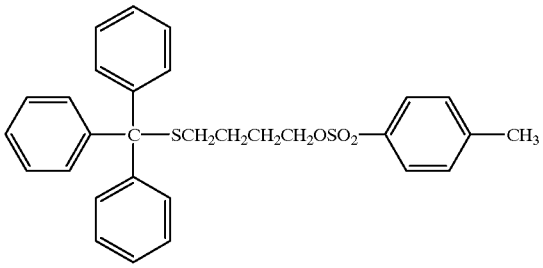
Examples of a compound useful for the present invention, which can generate an acid by the action of light, are illustrated below, but it should be understood that these examples are not to be construed as limiting the scope of the invention in any way.
A-(51)
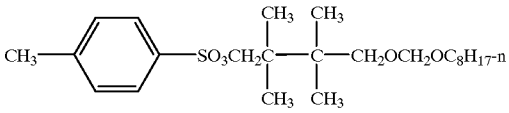
A-(52)
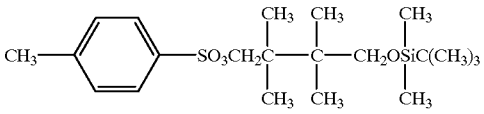
A-(53)
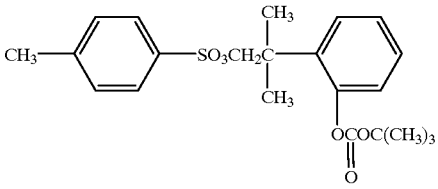
-continued
A-(54)
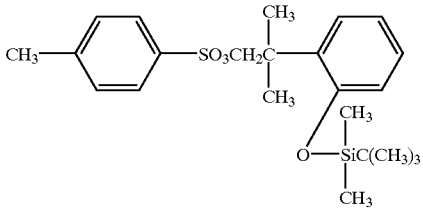
A-(55)
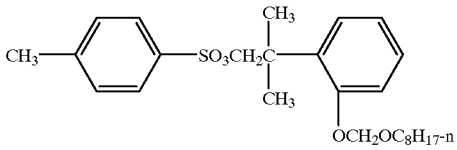
A-(56)
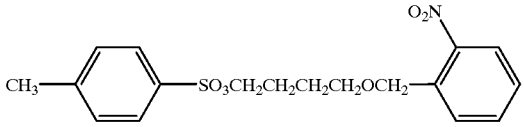
A-(57)
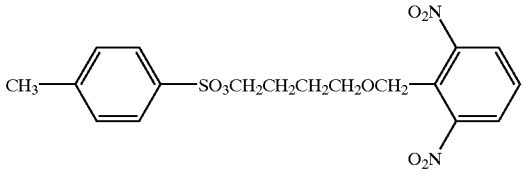

-continued
A-(58)
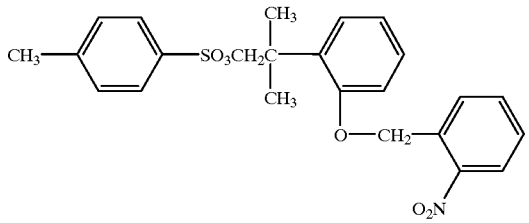
A-(59)
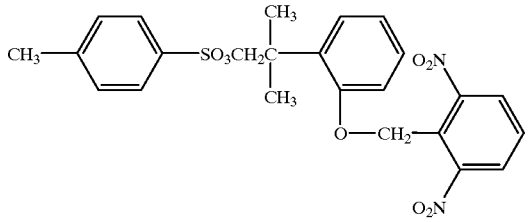
A-(60)
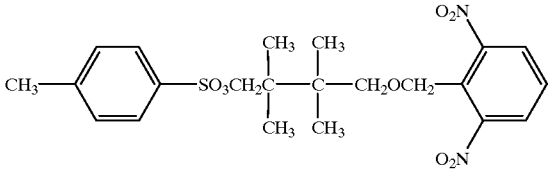
A-(61)
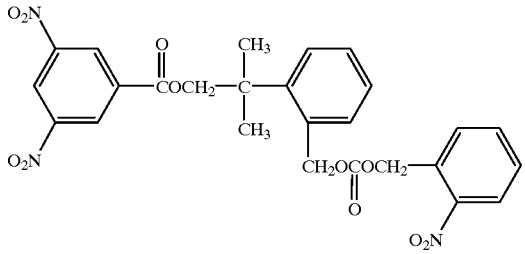
A-(62)
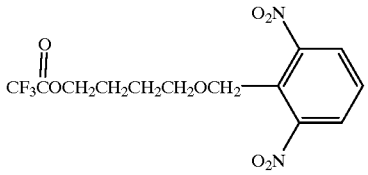
A-(63)
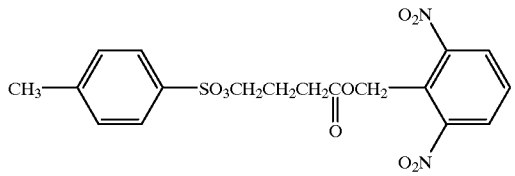
A-(64)
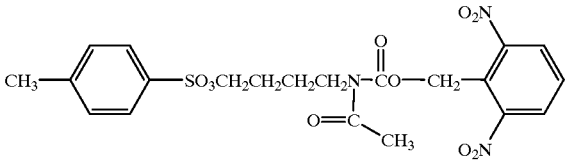
-continued
A-(65)
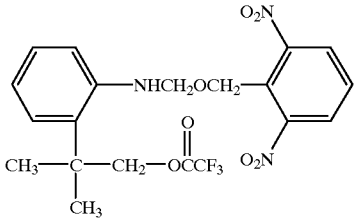
A-(66)
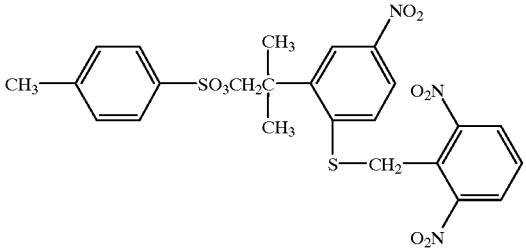
A-(67)
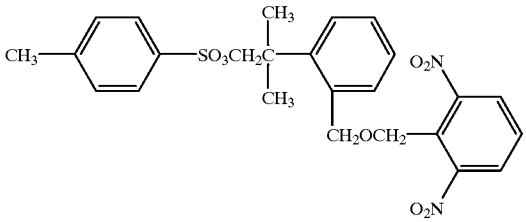
A-(68)
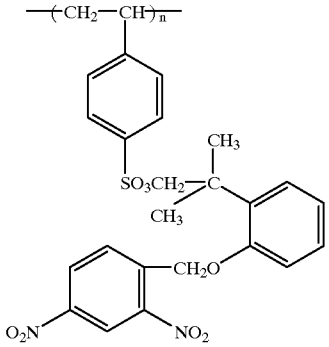
n represents an integer.
A-(69)
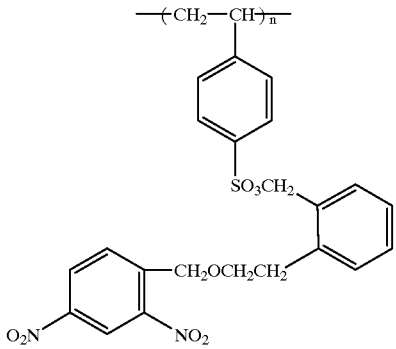
n represents an integer.

Similar to the method described in the above-cited reference, *Journal of Organic Chemistry,* vol. 53, pp. 318–327, the method usable for preparing the present compounds comprises introducing a protective group P into HX—(L)—C($R^1$)($R^2$)—OH to obtain a product PX—(L)—($R^1$)($R^2$)—OH and reacting the product with an acid halide under a basic condition.

In cases where the present image recording media containing the compound capable of generating an acid by the aaction of heat or an acid are used as materials of the type which record images in a photon mode, they necessitate adding thereto a photoacid generator.

On the other hand, it is unnecessary to add any other special thermo-acid generators when the present recording materials are used as materials of the type which record images in a laser heat mode, because the aforementioned compounds capable of generating an acid by the action of heat or an acid generate acids by the evolution of heat upon irradiation with laser beams. However, if the thermo-acid generation efficiency is low, different compounds capable of efficiently producing acids by the action of heat upon irradiation with laser beams may further be added for the purpose of increasing the sensitivity.

As the photoacid generators which can be used together with the above compounds capable of generating an acid by the action of heat or an acid, there maybe used the compounds capable of generating an acid by the action of light according to the present invention.

Further, in a book entitled "Organic Materials for Imaging", pages 187–198, edited by Meeting for Study of Organic Electronics Materials, published by Bunshin Shuppan in 1993, there is a description of various examples of the compounds (including nonionic compounds such as halides capable of generating hydrogen halide, sulfonates capable of generating sulfonic acid, carbonylated compounds capable of generating carboxylic acid and phosphorus-containing compounds capable of generating phosphoric acid, and ionic compounds such as various onium salts). Any of these compounds can be used in the present invention. In addition, various sensitizers (as described in, e.g., *J. Polymer Sci.,* 16, 2441 (1978)) can also be added for the purpose of widening the sensitive region of those photo-acid generators.

Preferred examples of a photoacid generator which can be used in combination with the compound capable of generating an acid by the action of heat or an acid according to the present invention, other than the compound capable of generating an acid by the action of light according to the present invention, are illustrated below. However, the invention should not be construed as being limited to these examples.

AG-(1)

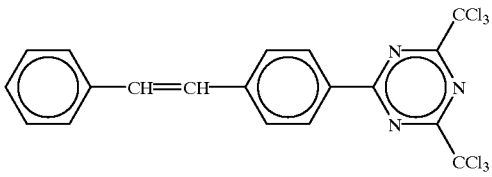

-continued

AG-(2)

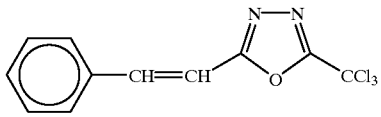

AG-(3)

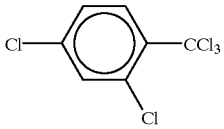

AG-(4)

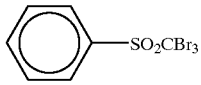

AG-(5)

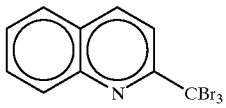

AG-(6)

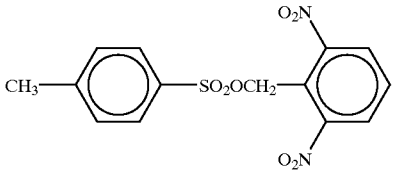

AG-(7)

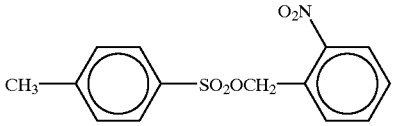

AG-(8)

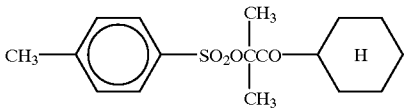

AG-(9)

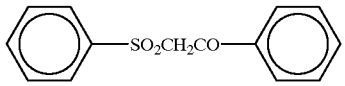

AG-(10)

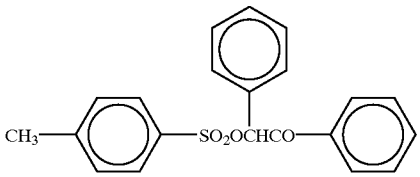

AG-(11)

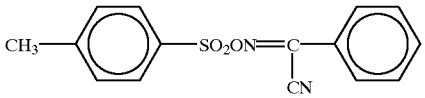

-continued
AG-(12)
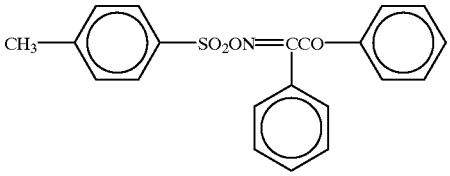
AG-(13)
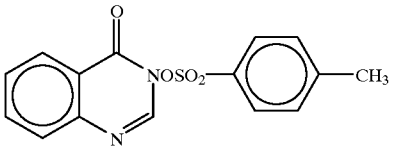
AG-(14)
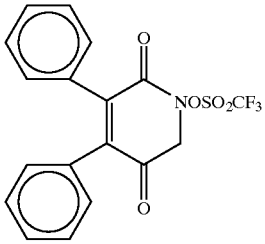
AG-(15)
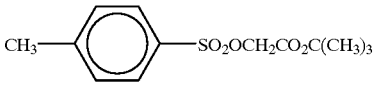
AG-(16)
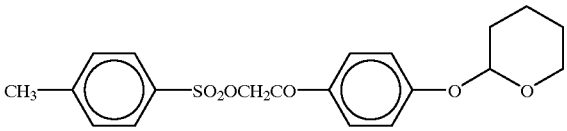
AG-(17)
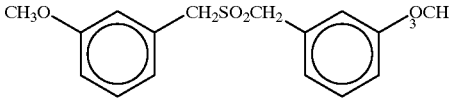
AG-(18)
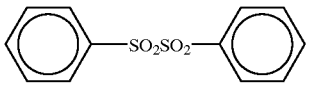
AG-(19)
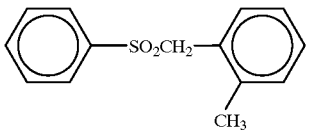
AG-(20)
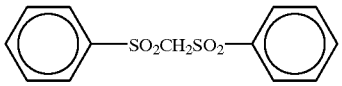
AG-(21)
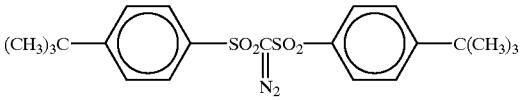
-continued
AG-(22)
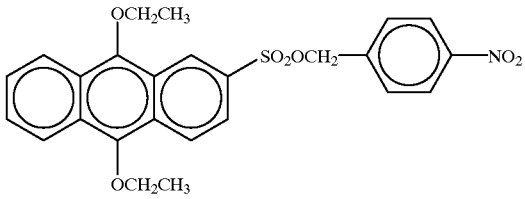
AG-(23)
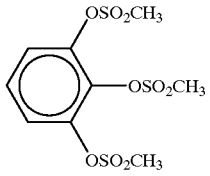
AG-(24)
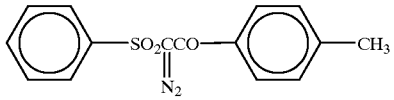
AG-(25)
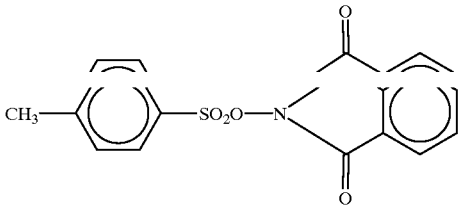
AG-(26)
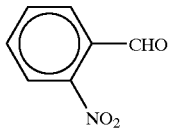
AG-(27)
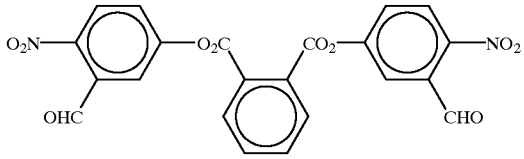
AG-(28)
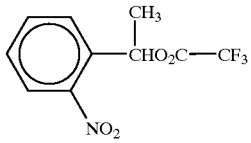
AG-(29)
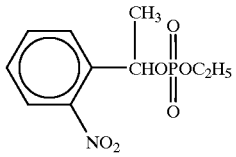

-continued
AG-(30)
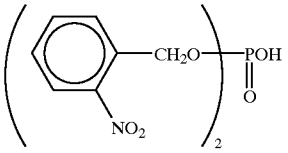
AG-(31)
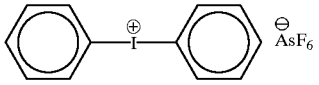
AG-(32)
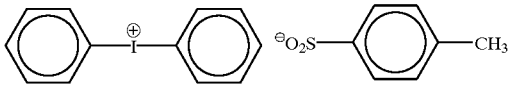
AG-(33)
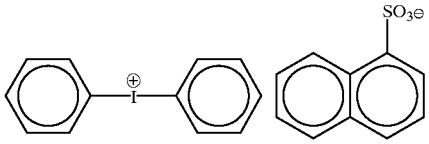
AG-(34)
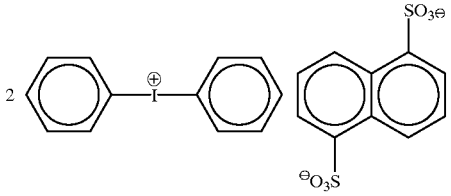
AG-(35)
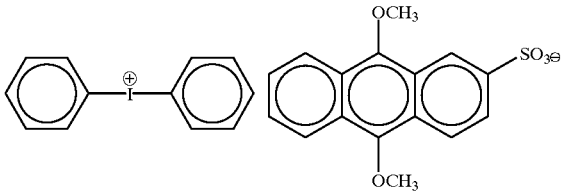
AG-(36)
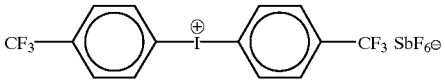
AG-(37)
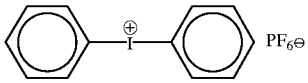
AG-(38)
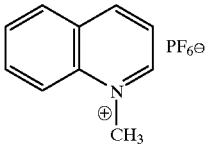
AG-(39)
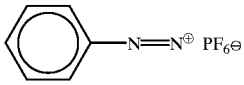
-continued
AG-(40)
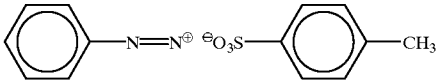
AG-(41)
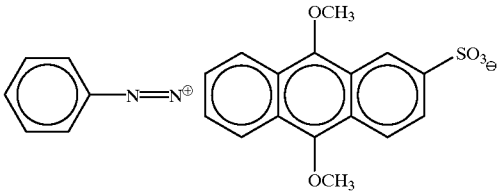
AG-(42)
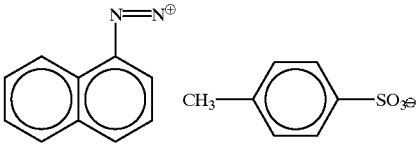
AG-(43)
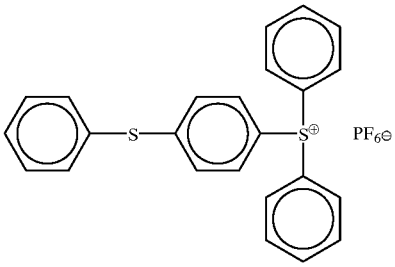
AG-(44)
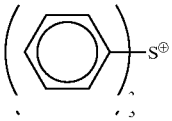
AG-(45)
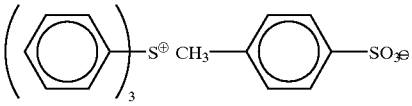
AG-(46)
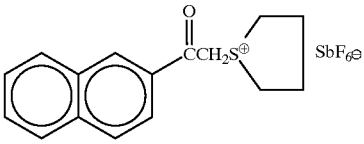
AG-(47)
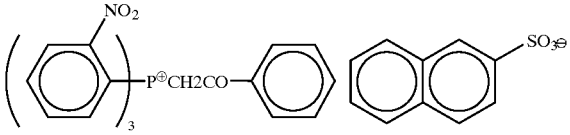
AG-(48)
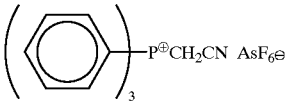

-continued

AG-(49)

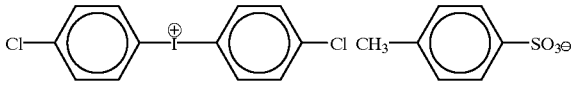

AG-(50)

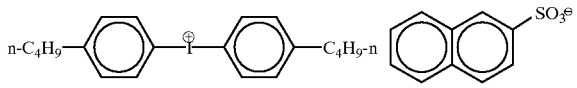

When the compounds capable of generating an acid by the action of heat or an acid according to the present invention are used for the image recording media in a laser heat mode, of the thermo-acid generators which can further be added for the purpose of increasing the sensitivity, the sulfonates, the $PF_6^-$ salts, the $AsF_6^-$ salts and the $SbF_6^-$ salts of aromatic onium compounds, including diazonium, iodonium, sulfonium and phosphonium, can be classified as the first group. They are also compounds capable of generating acids by the action of light, with examples including those recited above with respect to the photo-acid generators.

The thermo-acid generators classified as the second group are the ammonium salts or amine complexes of acids. The ammonium salts of acids are synthesized by neutralizing acids with ammonia or amines. Examples of such acids include p-toluenesulfonic acid, benzenesulfonic acid, 1,8-naphthalenedisulfonic acid, p-nitrobenzoic acid, 2,4-dichlorobenzoic acid, phenylphosphonic acid and $HPF_6$. As examples of an amine complex of acid, mention may be made of complexes prepared by mixing $BF_3.ET_2O$ with amines. These amines may be any of primary, secondary and tertiary amines. In particular, volatile amines are preferred over the others. Suitable examples of such an amine include methylamine, ethylamine, isopropylamine, t-butylamine, aniline and pyridine.

Examples of an ammonium salt of acid are illustrated below. However, the invention should not be construed as being limited to these examples

AG-(51)

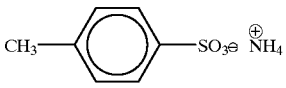

AG-(52)

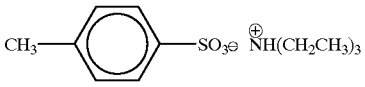

AG-(53)

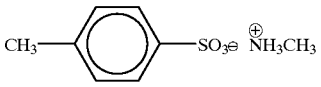

AG-(54)

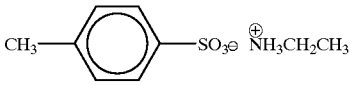

-continued

AG-(55)

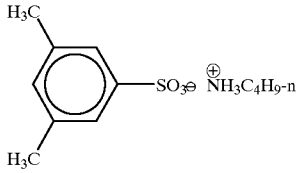

AG-(56)

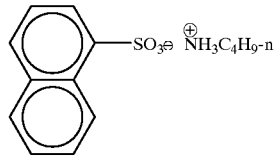

AG-(57)

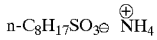

AG-(58)

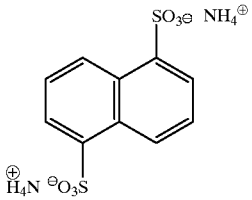

AG-(59)

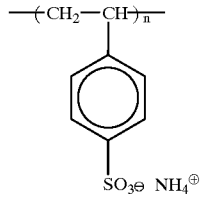

AG-(60)

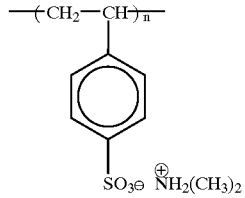

AG-(61)

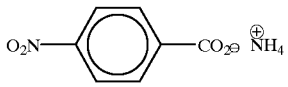

AG-(62)

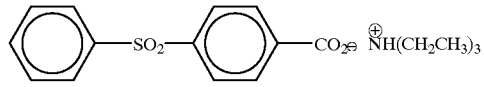

AG-(63)

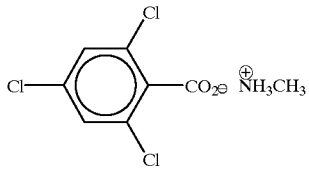

-continued

AG-(64)

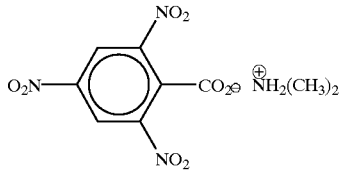

AG-(65)

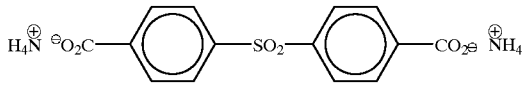

AG-(66)

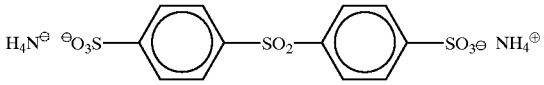

AG-(67)

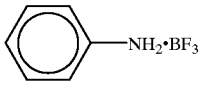

AG-(68)

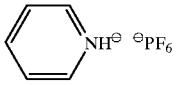

AG-(69)

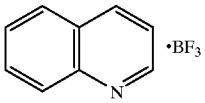

AG-(70)

$(CH_3CH_2)_3N \cdot BF_3$

AG-(71)

$CH_3NH \cdot BF_3$

AG-(72)

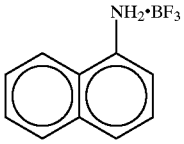

AG-(73)

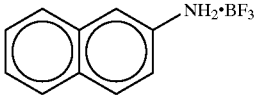

The thermo-acid generators classified as the third group are compounds capable of generating acids through the elimination of β-hydrogen upon heating. Examples of such a compound include β-hydrogen containing alkyl esters (e.g., t-butyl ester, cyclohexyl ester, 2-phenylethyl ester, 4,5-dihydro-2-methylfuran-5-yl ester, 2-cyclohexenyl ester) of sulfonic acid; carboxylic acid or phosphoric acid, and the compounds of the following formula (2):

$$YO—N=CH—Z \quad (2)$$

wherein Y represents a residue of sulfonic, carboxylic or phosphoric acid of formula YOH, and Z represents a substituted or unsubstituted aryl group, preferably having 6 to 60 carbon atoms, with examples including phenyl, 2,4-dimethoxyphenyl, 1-naphthyl, 2-methoxy-1-naphthyl and 2-chloro-1-naphthyl groups.

Examples of a compound capable of generating an acid through the elimination of β-hydrogen upon heating are illustrated below. However, the invention should not be construed as being limited to these examples.

AG-(74)

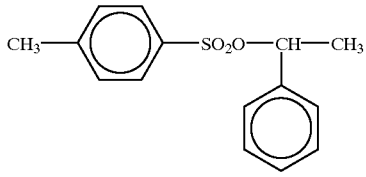

AG-(75)

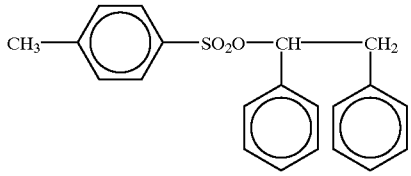

AG-(76)

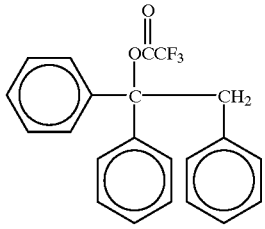

AG-(77)

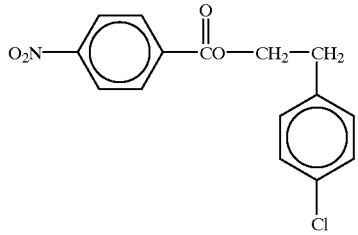

AG-(78)

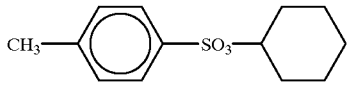

AG-(79)

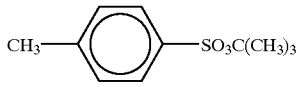

AG-(80)

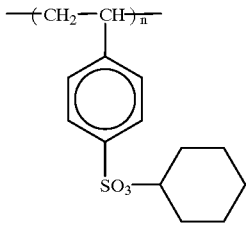

-continued

AG-(81)

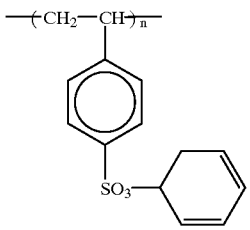

AG-(82)

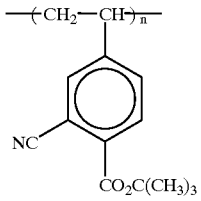

AG-(83)

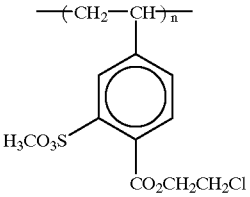

AG-(84)

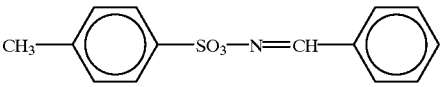

AG-(85)

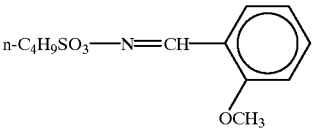

AG-(86)

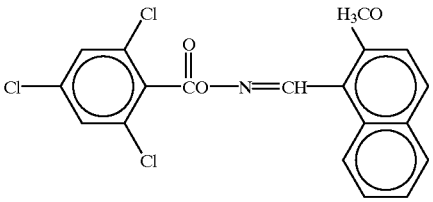

AG-(87)

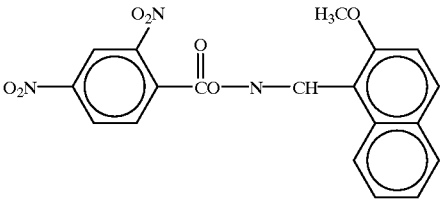

-continued

AG-(88)

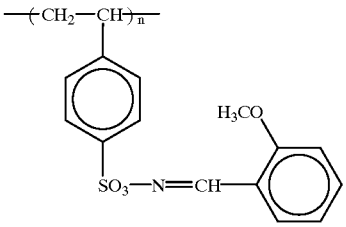

AG-(89)

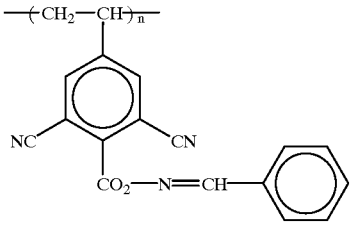

AG-(90)

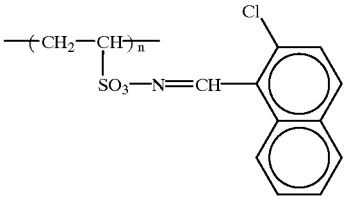

The thermo-acid generators classified as the fourth group are 2-nitrobenzyl esters or benzoin esters of sulfonic acid, carboxylic acid and phosphoric acid. These esters are also compounds producing acids by the action of light. As examples of such esters, mention may be made of those recited above with respect to photo-acid generators.

Any of the thermo-acid generators recited above can be used in the present invention, but it is desirable for the thermo-acid generator used to have its decomposition temperature in the range of 130° C. to 300° C., particularly preferably 150° C. to 250° C.

The present image recording media can be applied to not only the so-called photoresist which utilizes a structural change caused by the action of an acid catalyst to render its photosensitive layer soluble or insoluble in polar or alkaline solvents, but also recording materials of the type which form color or UV images in combination with compounds capable of developing colors or being decolorized by the action of an acid catalyst.

The term "compounds changing their absorption in the range of 360 to 900 nm as a result of acceleration of their intramolecular or intermolecular reactions by the action of an acid" as used in the present invention refers to the compounds which, though stable upon storage under a neutral or basic condition, can lower the activation energy for their intramolecular or intermolecular reaction when undergo the action of an acid, and thereby enable easy progress of the reaction under heating to cause their absorption change in the aforesaid wavelength range. The heating temperature for forming images therein ranges preferably from 50° C. to 300° C., particularly preferably from 80° C.

to 150° C. The reaction for forming developed color or decolorized images can be effected simultaneously with the generation of an acid.

The compound attended with such an absorption change may be a single compound or a combination of two or more components. Examples of such a compound include the compounds forming decolorized images in the foregoing region by Diels-Alder reaction (e.g., 9,10-distyrylanthracene and maleic anhydride, tetraphenylcyclopentadiene and an acrylic acid ester), the compounds forming developed color images in the foregoing region by containing therein a conjugated system capable of being elongated by elimination of β-hydrogen (e.g., 1-acetoxy-1,2-diarylethane, 1-sulfoxy-1,2-diarylethane), the combinations of aldehydes with active methylene compounds which form developed color images in the foregoing region by dehydration condensation (e.g., the combinations of photographic four-equivalent magenta couplers with p-methoxycinnamaldehyde) and the compounds containing in each molecule an amino or hydroxyl group substituted with a substituent the decomposition or elimination of which is accelerated by the action of an acid and changing their absorption in the foregoing region by the removal of the substituent. In addition, basic leuco dyes which develop colors immediately upon contact with an acid (e.g., diarylphthalides, fluorans, bisindolylphthalides, arylindolylphthalides, acylleucosins, leucoauramines, spiropyrans, rhodaminelactams, leucotriarylmethanes, diarylchromans) can be used in the image forming materials. However, such compounds function as base to inhibit the acid multiplication process, so that it is necessary to separate them from acid generators by microencapsulation or incorporation in a different layer.

Of these compounds, the compounds undergoing a change in their absorption when the substituents of amino or hydroxyl groups present therein are decomposed or eliminated by the action of an acid are especially useful in the present invention.

Examples of a substituent advantageously substituted for the hydrogen of the amino group include alkoxycarbonyl groups (e.g., t-butoxycarbonyl, cyclohexyloxycarbonyl, 1,1-dimethylpropyloxycarbonyl, 1-methyl-1-phenylethoxycarbonyl, 2-chloroethoxycarbonyl), acyl groups (e.g., acetyl, benzoyl, 2-nitrobenzolyl, 4-chlorobenzoyl, 1-naphthoyl) and formyl group. In particular, the alkoxycarbonyl groups having a hydrogen atom at the β-position are preferred over the others from the viewpoints of storage stability and thermal sensitivity.

Such compounds are disclosed in, e.g., U.S. Pat. Nos. 4,602,263 and 4,826,976.

Examples of a compound useful in the present invention, which contains an amino group substituted with the substituent as recited above, are illustrated below. However, the invention should not be construed as being limited to these examples.

B-(1)

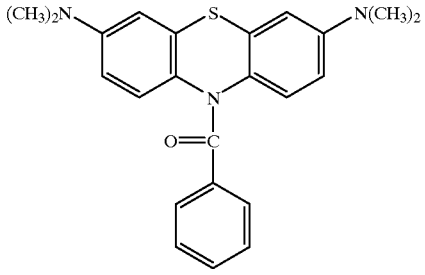

B-(2)

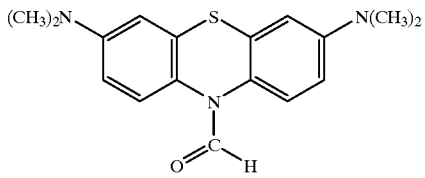

B-(3)

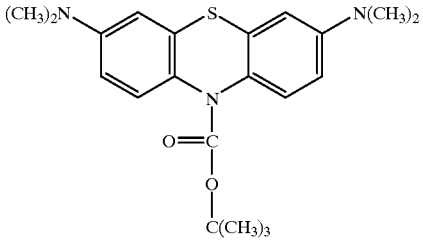

B-(4)

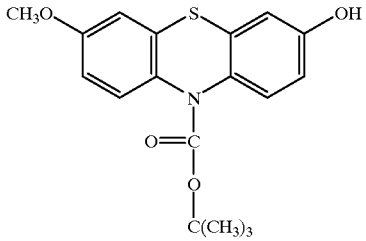

B-(5)

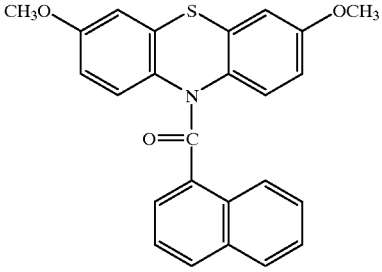

B-(6)

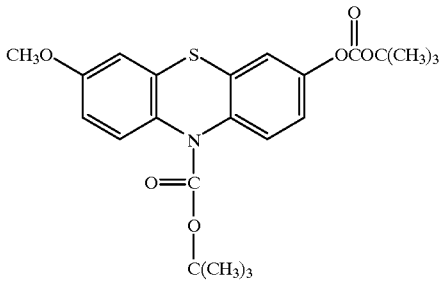

-continued
B-(7)
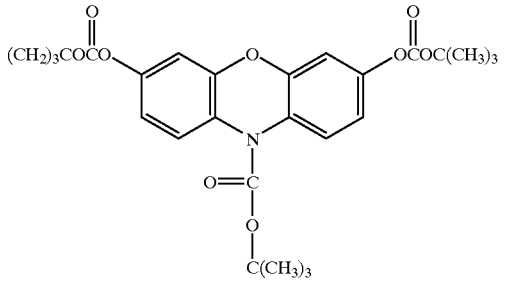
B-(8)
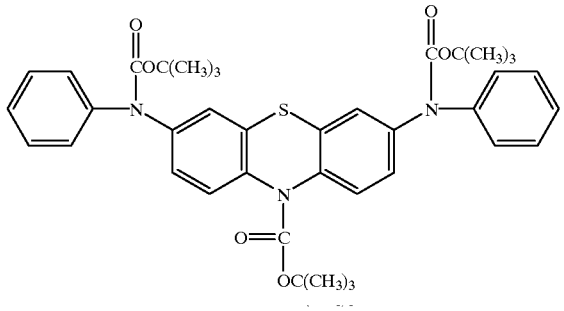
B-(9)
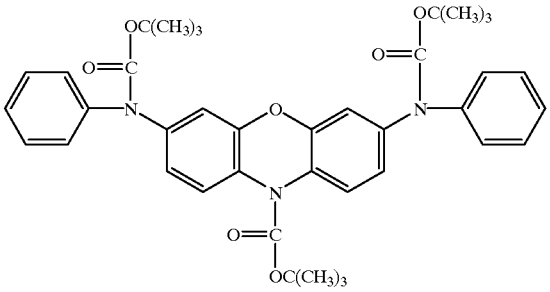
B-(10)
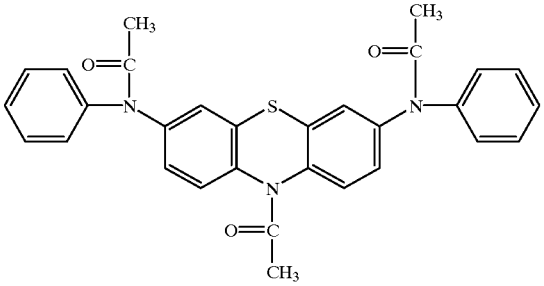
B-(11)
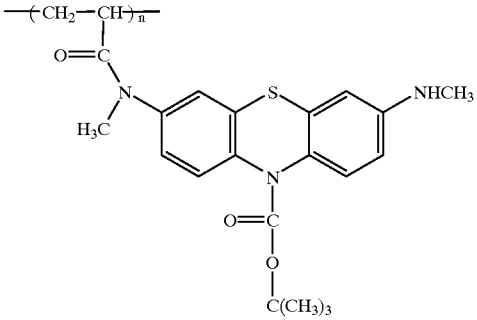
B-(12)
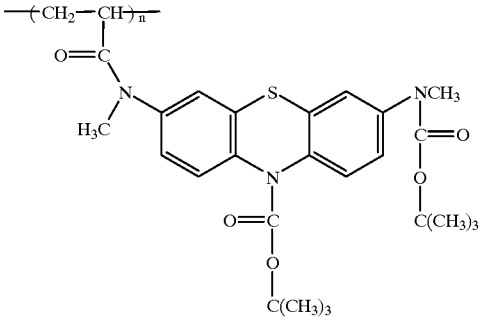
B-(13)
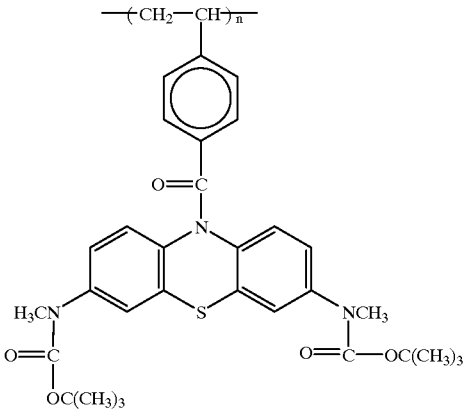

-continued
B-(14)
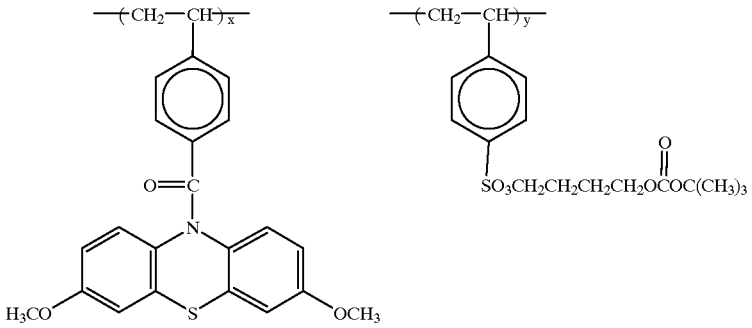
x:y = 1:1
B-(15)
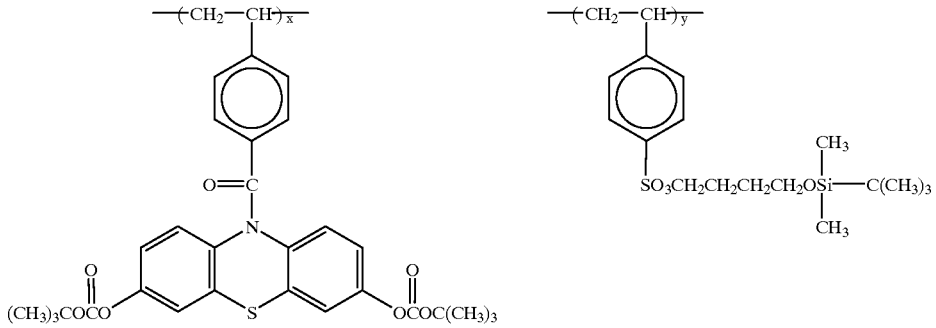
x:y = 1:1
B-(16)
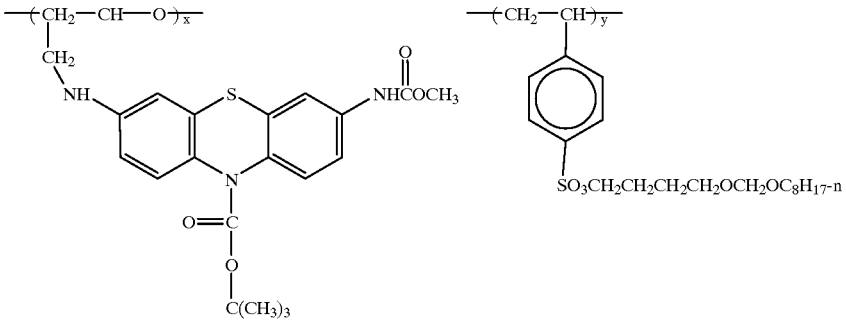
x:y = 1:1
B-(17)
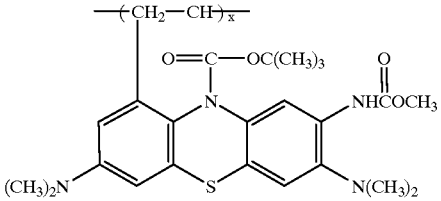
B-(18)
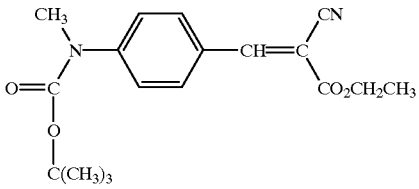

-continued
B-(19)
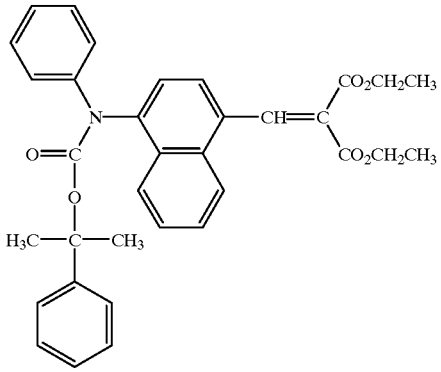
B-(20)
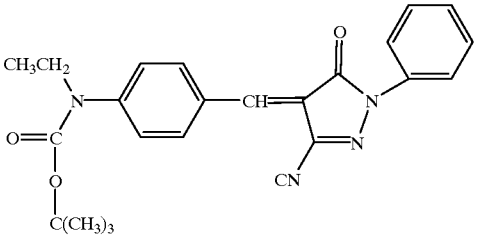
B-(21)
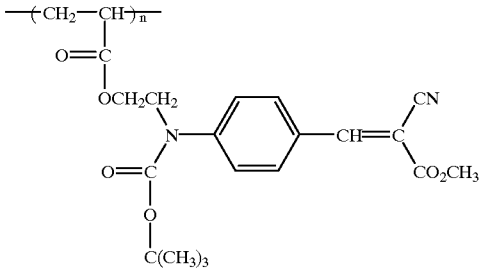
B-(22)
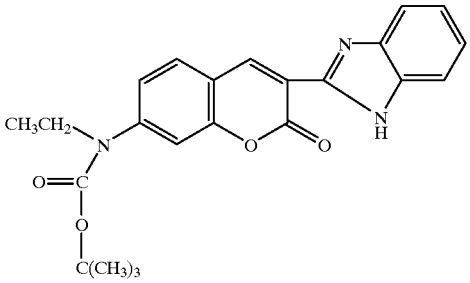
B-(23)
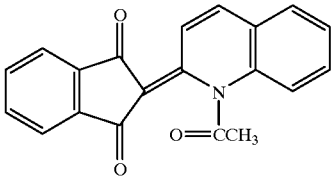
B-(24)
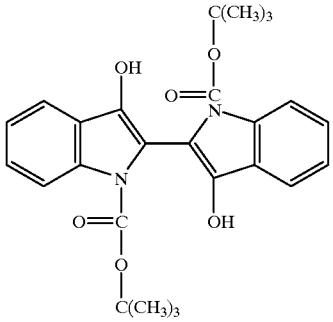
B-(25)
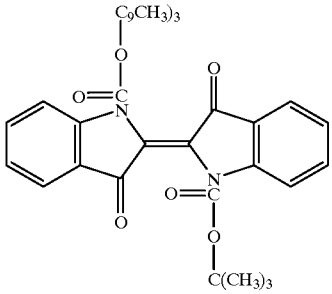

-continued
B-(26)
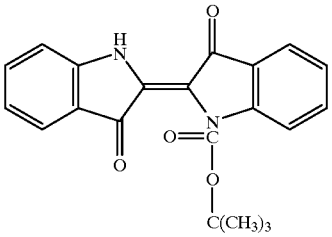
B-(27)
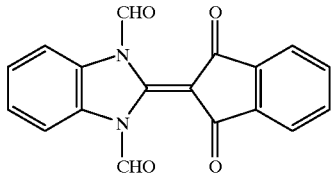
B-(28)
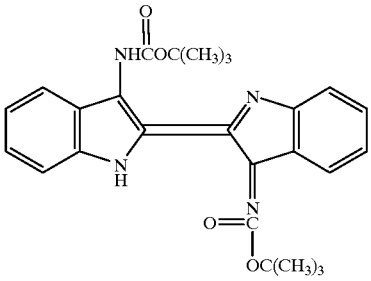
B-(29)
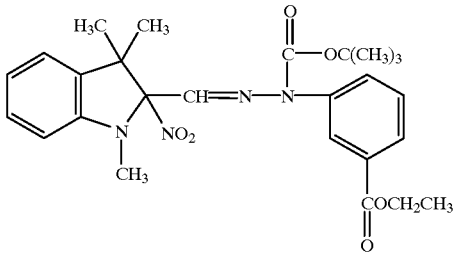
B-(30)
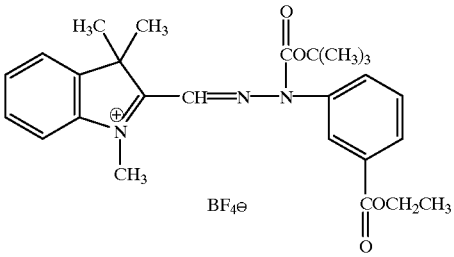
B-(31)
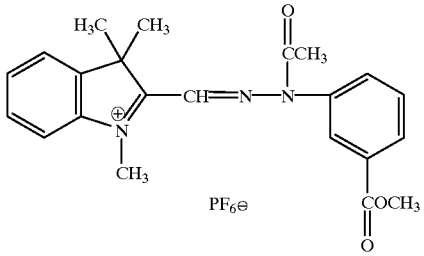
B-(32)
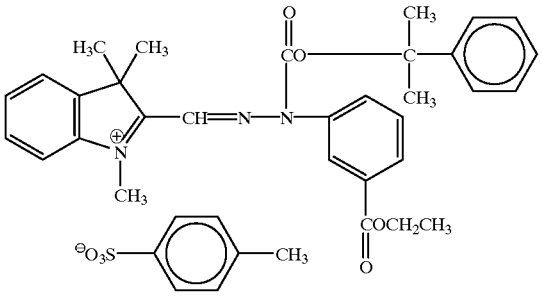
B-(33)
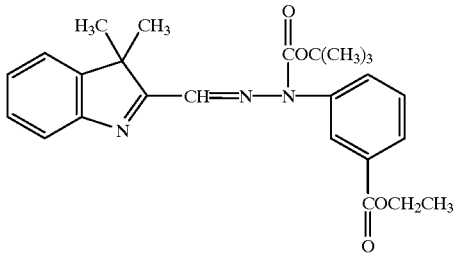
B-(34)
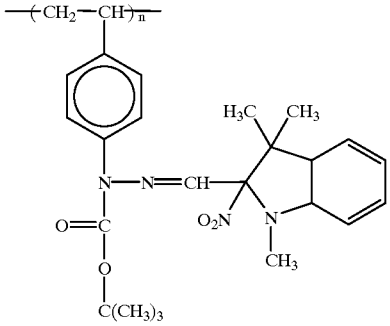
B-(35)
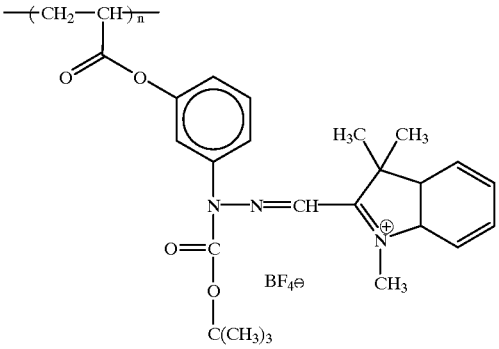

-continued

B-(36)

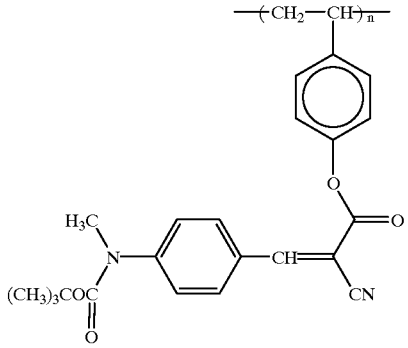

Examples of a substituent advantageously substituted for the hydrogen of the hydroxyl group, which is decomposed or eliminated by the action of an acid, include secondary or tertiary alkoxycarbonyl groups having a hydrogen atom at the β-position (e.g., t-butoxycarbonyl, isopropyloxycarbonyl, 1-phenylethoxycarbonyl, 1,1-diphenylethoxycarbonyl, 2-cycloexeneoxycarbonyl), silyl groups (e.g., trimethylsilyl, triethylsilyl, t-butyldimethylsilyl, t-butyldiphenylsilyl, phenyldimethylsilyl), alkoxymethyl groups (e.g., methoxymethyl, ethoxymethyl, 1-methoxyethyl, 1-phenoxyethyl, 1-methyl-1-methoxyethyl) and secondary or tertiary alkyl groups having a hydrogen atom at the β-position (e.g., tetrahydropyranyl, tetrahydrofuranyl, 4,5-dihydro-2-methylfuran-5-yl, t-butyl, 2-cyclohexenyl). Of these substituents, secondary or tertiary alkoxycarbonyl groups having a hydrogen atom at the β-position are particularly preferred in the present invention.

The description of compounds the absorption of which is changed by decomposition of substituents of the hydroxyl groups present therein can be found in, e.g., U.S. Pat. No. 5,243,052 and JP-A-9–25360.

Examples of a compound useful in the present invention, which changes its absorption in the foregoing region through the decomposition of a substituent of the hydroxyl group, are illustrated below. However, the invention should not be construes as being limited to these examples.

C-(1)

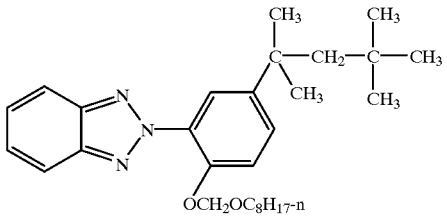

C-(2)

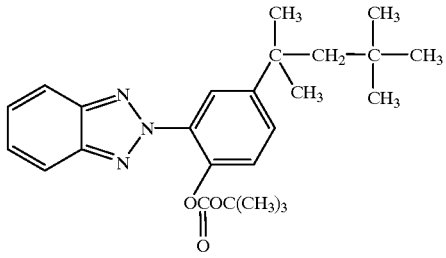

C-(3)

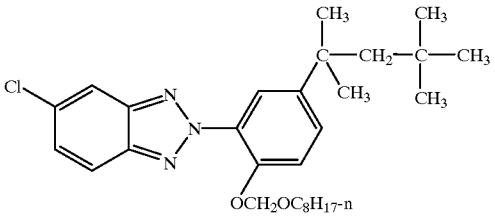

C-(4)

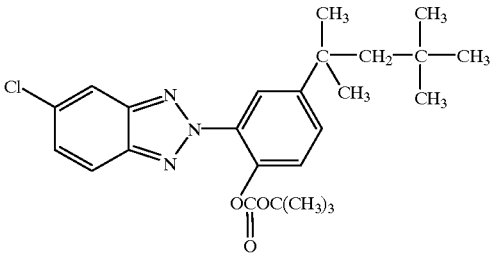

-continued
C-(5)
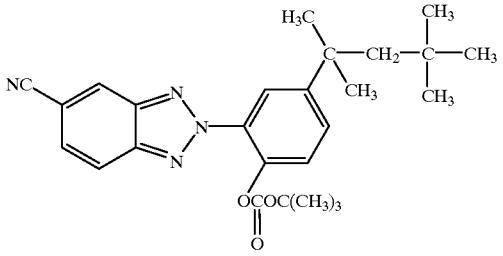
C-(6)
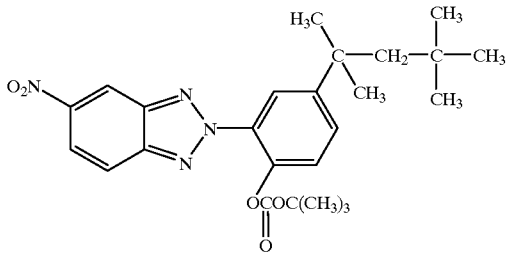
C-(7)
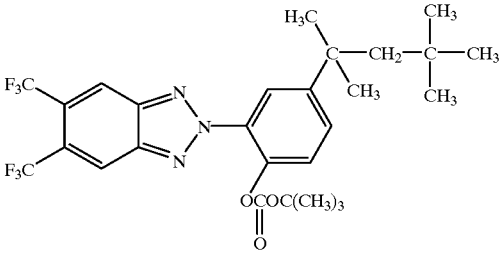
C-(8)
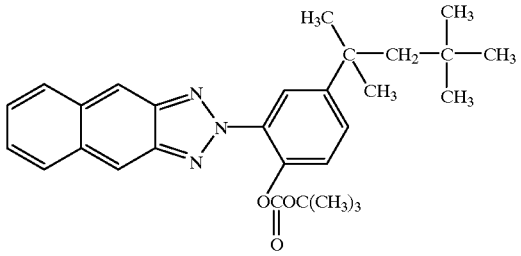
C-(9)
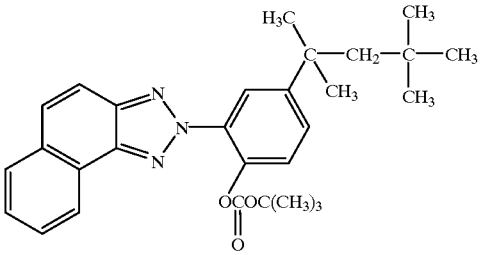
C-(10)
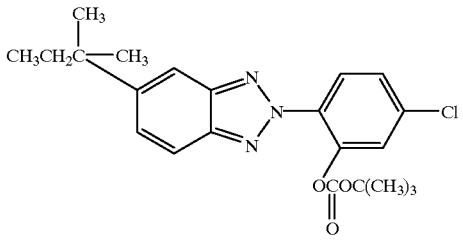
C-(11)
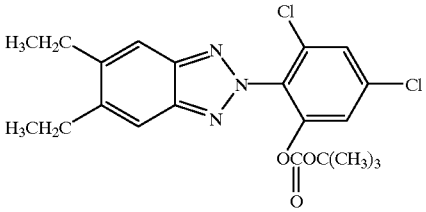
C-(12)
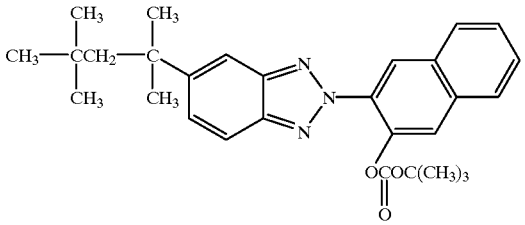
C-(13)
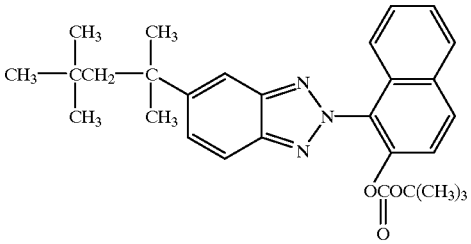
C-(14)
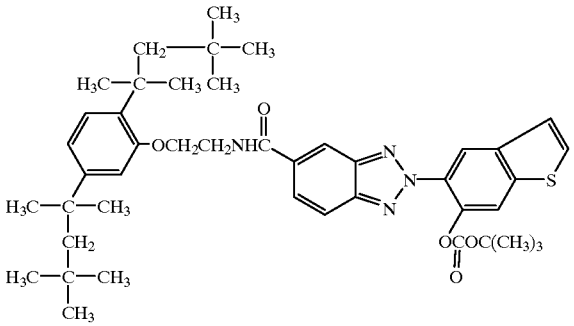

-continued
C-(15)
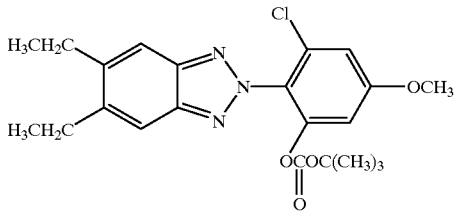
C-(16)
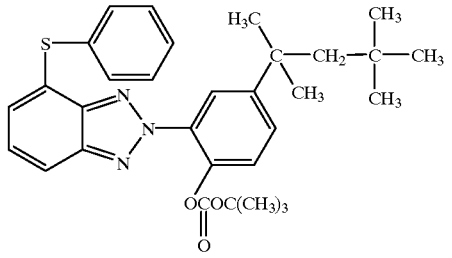
C-(17)
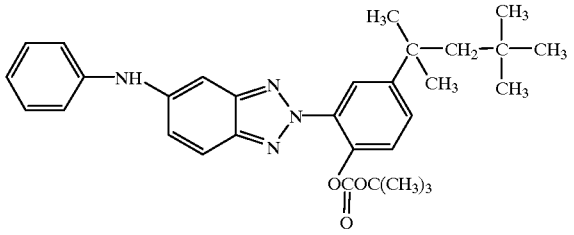
C-(18)
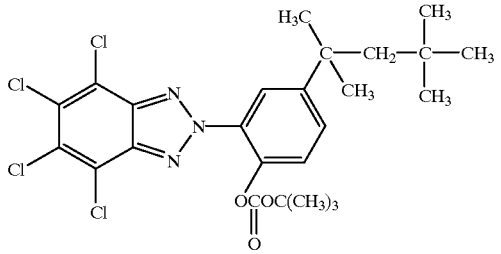
C-(19)
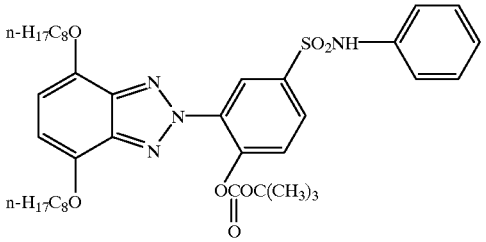
C-(20)
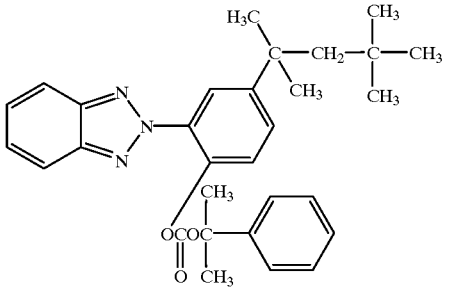
C-(21)
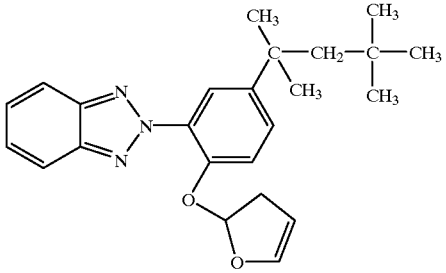
C-(22)
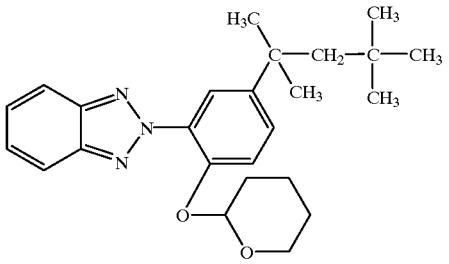
C-(23)
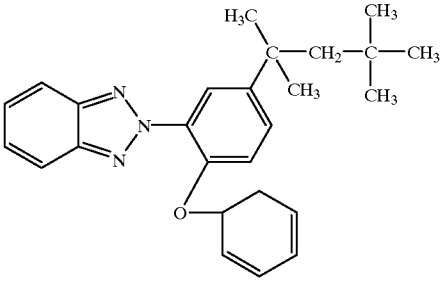
C-(24)
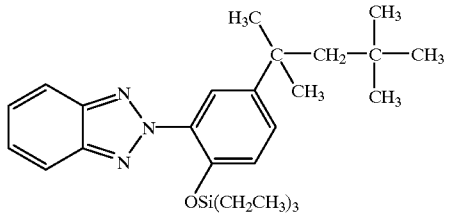

-continued
C-(25)
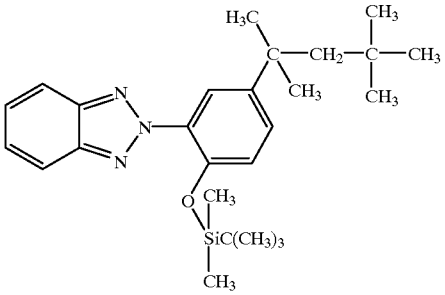
C-(26)
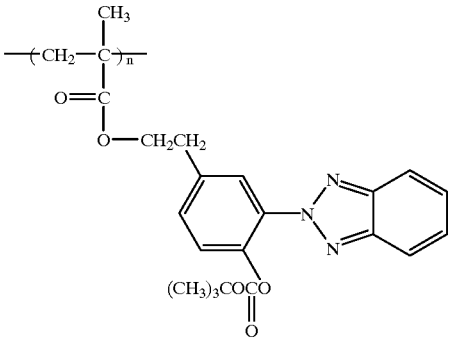
C-(27)
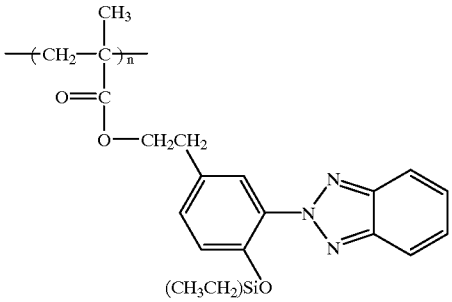
C-(28)
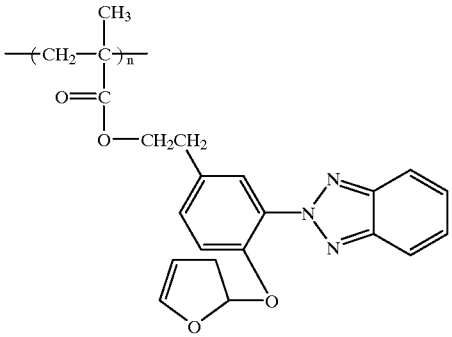
C-(29)
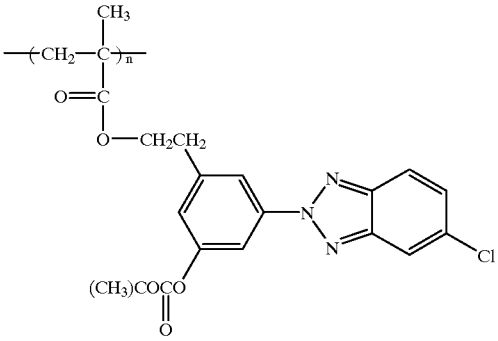
C-(30)
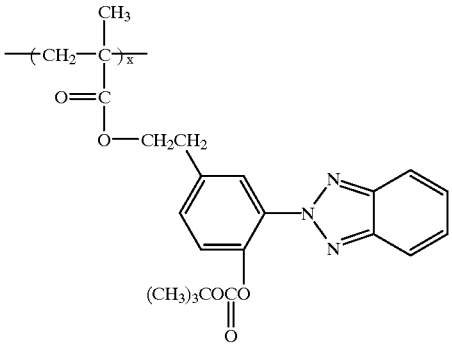
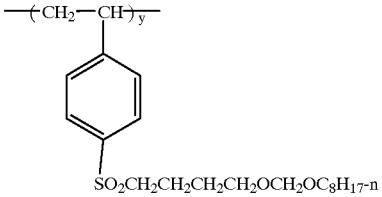
x:y = 1:1

-continued
C-(31)
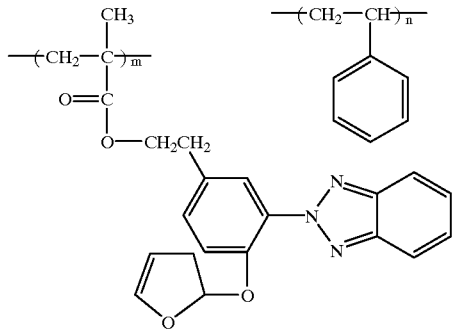
C-(32)
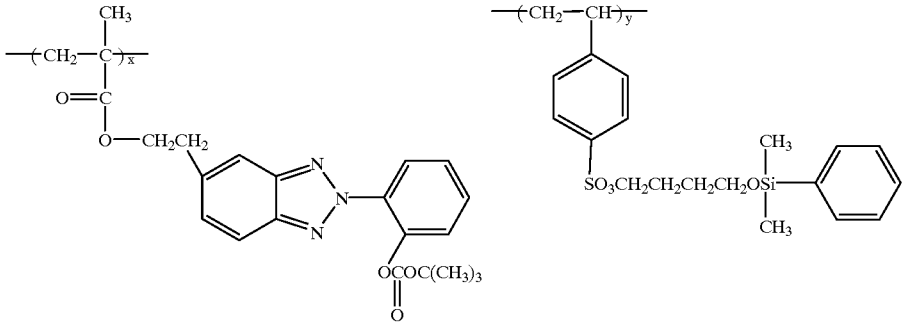
x:y = 1:1
C-(33)
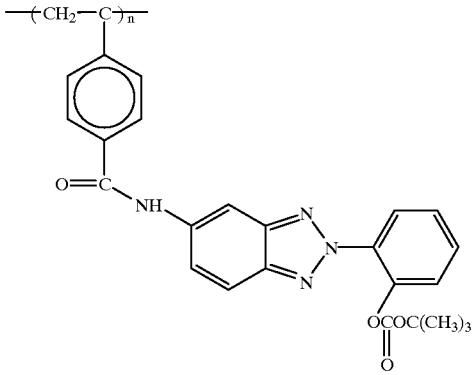
C-(34)
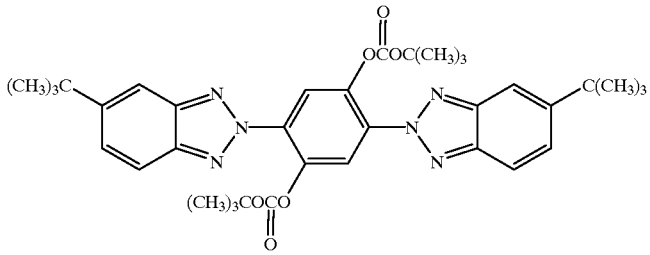
C-(35)
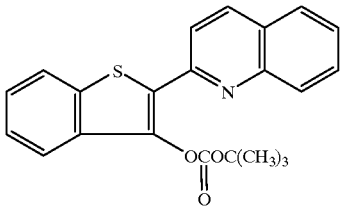
C-(36)
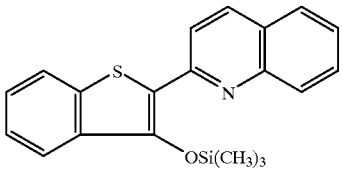

-continued
C-(37)
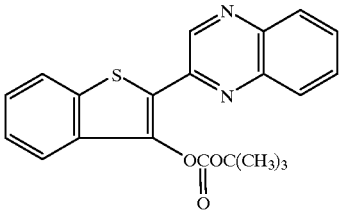
C-(38)
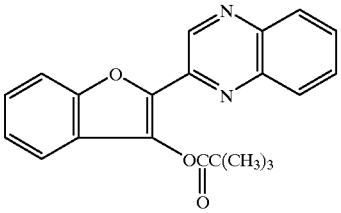
C-(39)
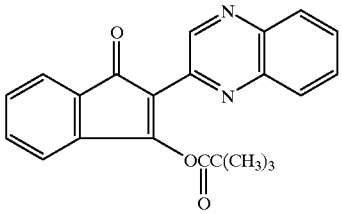
C-(40)
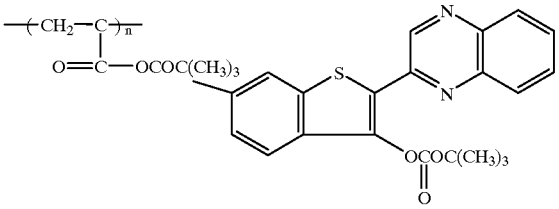
C-(41)
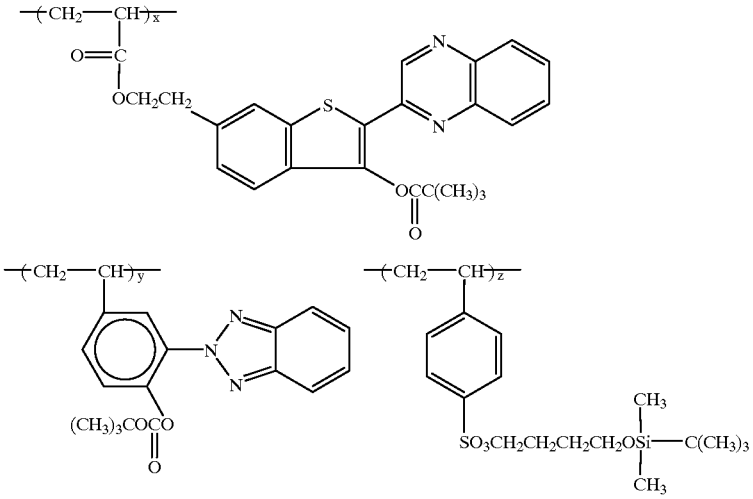
x:y:z = 1:1:2
C-(42)
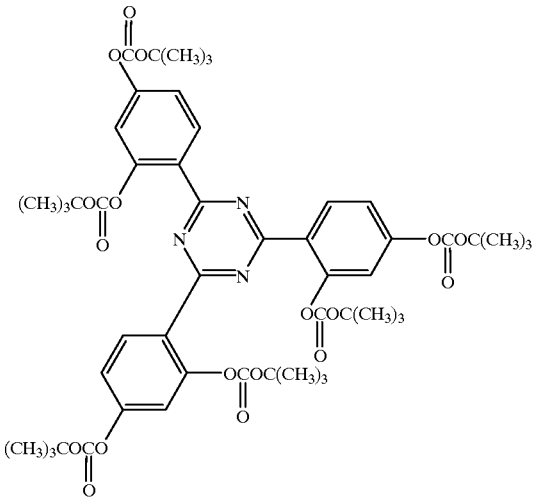
C-(43)
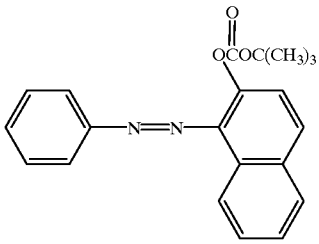

-continued
C-(44)
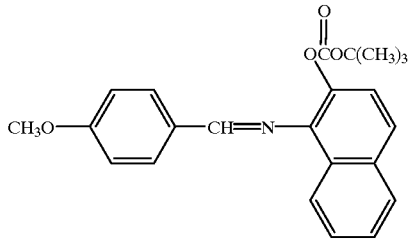
C-(45)
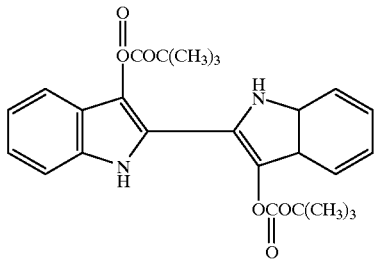
C-(46)
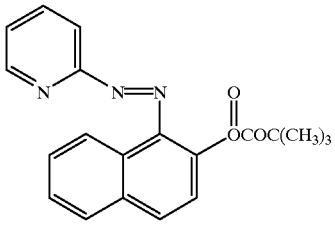
C-(47)
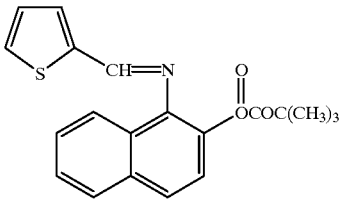
C-(48)
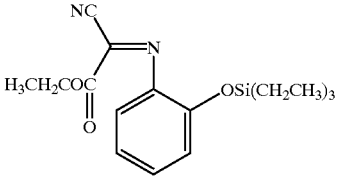
C-(49)
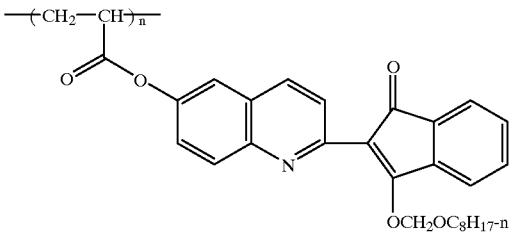
C-(50)
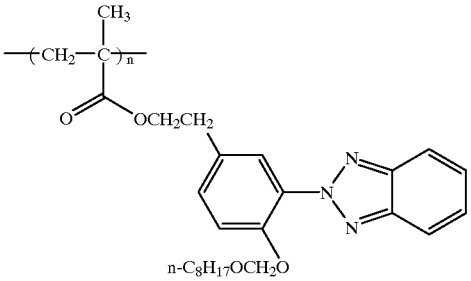
C-(51)
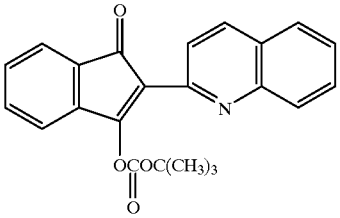
C-(52)
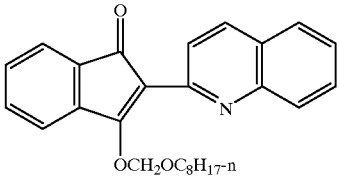
C-(53)
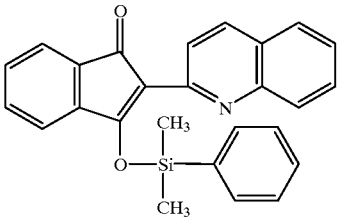

-continued

C-(53)

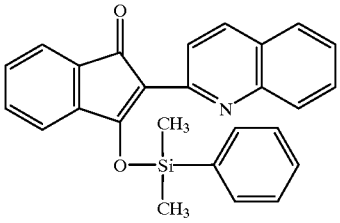

The present image recording medium of color image formation type is prepared by coating a support with the present acid generator of intramolecular nucleophilic substitution type, a composition causing a change in the absorption region of 360–900 nm by the action of an acid and, if needed, a compound generating an acid by the action of light or heat. In coating these components, a binder is generally used together therewith, except for the case where one of the coating components is a polymer or amorphous substance having good coatability. For the purpose of enhancing the storage stability of the foregoing image recording medium, a small amount of base can further be added. Also, various additives, such as pigments, antioxidants and sticking inhibitors, maybe added, if desired. In addition, an overcoat layer may be provided for the purpose of protecting the image forming layer, and a backing layer may be provided on the back side of the support. Furthermore, various known techniques for heat-sensitive recording materials, e.g., the technique of forming a single or multiple layer of a pigment or resin as an undercoat layer between the image forming layer and the support, can be applied to the present image recording medium.

The addition amount of the present acid generator of intramolecular nucleophilic substitution type depends on the species of the compound causing a change in its absorption by the action of an acid. However, it ranges generally from 0.1 to 20 equivalents, particularly preferably from 0.5 to 5 equivalents, to the compound causing the absorption change.

In adding a base to the present image recording medium, it is desirable for the base to be selected from organic bases. Suitable examples of such an organic base include guanidine derivatives (e.g., 1,3-diphenylguanidine, 1,3-dimethylguanidine, 1,3-dibutylguanidine, 1-benzylguanidine, 1,1,3,3-tetramethylguanidine), aniline derivatives (e.g., aniline, p-t-butylaniline, N,N'-dibutylaniline, N,N'-dimethylaniline, triphenyl-amine), alkylamine derivatives (e.g., tributylamine, octylamine, laurylamine, benzylamine, dibenzylamine) and heterocyclic compounds (e.g., N,N'-dimethylaminopyridine, 1,8-diazabicyclo[5,4,0]-7-undecene, triphenylimidazole, lutidine, 2-picoline). It is desirable that these bases be added in a proportion of 0.01 to 100 mole %, particularly preferably 0.1 to 20 mole %, to the acid generators.

Examples of a binder usable therein include water-soluble binders, such as gelatin, casein, various kinds of starch, hydroxyethyl cellulose, carboxymethyl cellulose, polyvinyl alcohol, polyacrylamide and ethylene-maleic anhydride copolymer, and water-insoluble binders such as polyvinyl butyral, triacetyl cellulose, polystyrene, methylacrylate-butadiene copolymer and acrylonitrile-butadiene copolymer.

Examples of a pigment which can be added thereto include diatomaceous earth, talc, kaolin, calcined kaolin, titanium oxide, silicon oxide, magnesium carbonate, calcium carbonate, aluminum hydroxide and urea-formaldehyde resin.

As for other additives, ultraviolet absorbents of benzophenone or benzotriazole type, head abrasion and sticking inhibitors made up of metal salts of higher fatty acids, such as zinc stearate and calcium stearate, and waxes, such as paraffin, oxidized paraffin, polyethylene, polyethylene oxide and castor wax, can be added, if needed.

Examples of a support usable in the present image recording medium include various kinds of paper, such as wood-free paper, baryta paper, coated paper, cast-coated paper and synthetic paper, polymer films such as polyethylene, polypropylene, polyethylene terephthalate, polyethylene-2,6-dinaphthylenedicarboxylate, polyarylene, polyimide, polycarbonate and triacetyl cellulose films, glass, metal foils and nonwoven fabric.

In a case where the present image recording medium is intended for the formation of transmission images, e.g., as an OHP film or a graphic arts film, a transparent support is employed. Further, the support for a graphic arts film is selected from materials having small coefficient of thermal expansion, good dimensional stability and no absorption in the sensitivity region of the PS plate utilizing the present image recording medium.

Examples of a heating method usable as an image-forming means in a case where images are recorded on the present image recording medium in a heat mode include a method of bringing a heated block or plate into contact with the recording material, a method of bringing the recording material into contact with a hot roller or drum, a method of irradiating the recording material with a halogen lamp or an infrared to far infrared lamp heater, a method of heating imagewise the recording material with the thermal head of a heat-sensitive printer, and a method of irradiating the recording material with laser beams. When high resolution is required as in the case of a graphic arts material, the method of irradiation with laser beams is preferred over the others. Further, it is possible to heat in advance the present image recording medium up to an appropriate temperature for the purpose of forming images with less thermal energy.

In a case where images are formed by irradiation with laser beams, it is required for the present image recording medium to contain dyes absorbing light of the same wavelengths as the laser beams have in order to convert the energy of laser beams into thermal energy. Examples of a laser beam source useful for the present invention include excimer laser, argon laser, helium-neon laser, semiconductor laser, glass (YAG) laser, carbon dioxide laser and dye laser. Of these laser devices, helium-neon, semiconductor and glass laser devices are used to advantage over the other laser devices. In particular, semiconductor laser devices are useful because their price is low and their size is small. The oscillation wavelengths of semiconductor laser are generally in the range of 670 to 830 nm, so that the dyes having their absorption in the near infrared region are used. Examples of a near infrared absorbing dye include cyaninedyes, squaryliumdyes, merocyanine dyes, oxonol dyes and phthalocyanine dyes.

In the present invention, the acid catalyst is produced imagewise from the acid generator by the use of the aforementioned heating method, and then overall heating is carried out to amplify the image. Therein, it is necessary for the temperature of overall heating to be below the temperature at which the decomposition of the acid generator takes place in the non-image area. Further, in the case of using the present recording material as graphic arts material, it is required that the overall heating temperature be chosen so as to ensure dimensional stability for the substrate. Therefore, it is desirable that the heat development temperature in the present invention be from 60 to 150° C., especially from 80 to 120° C.

The laser beam source used in the case where a compound generating an acid by the action of light is added to the present image recording medium is selected so as to correspond with the absorption wavelengths of such an acid generator or a sensitizer added for widening the sensitivity region. The heat development after irradiation with laser beams is carried out in the same way as in the case of using a thermo-acid generator.

The present invention will now be illustrated in greater detail by reference to the following examples, but it should be understood that these examples are not to be construed as limiting the scope of the invention in any way.

The typical synthesis examples of the present acid generators of intramolecular nucleophilic substitution type are described below.

Synthesis Example 1

Synthesis of Exemplified Compound A-(1)

Exemplified Compound A-(1)

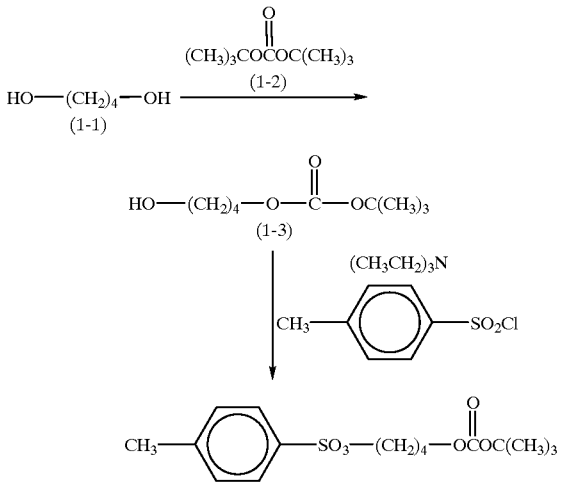

In 50 ml of THF was dissolved 5 g of 1,4-butanediol (1-1), and thereto was added 6.23 g of potassium t-butoxide. Thereto, 12.1 g of di-t-butyldicarbonate (1-2) was further added at room temperature, and stirred for 2 hours. The solution obtained was added to 100 ml of water, and the organic layer was extracted by addition of 200 ml of ethyl acetate thereto. Further, the extracted layer was washed twice with water, dried over magnesium sulfate, and then concentrated. The concentrate obtained was purified by column chromatography on silica gel, thereby yielding 3 g of Compound (1-3) as an oily substance.

$^1$H-NMR ($CDCl_3$) δ(ppm): 1.49 (s, 9H), 1.70 (m, 4H), 1.96 (br, 1H), 3.66 (t, 2H), 4.10 (t, 2H)

A 2 g portion of the Compound (1-3) obtained above was dissolved in 10 ml of methylene chloride, and thereto were added 1.57 ml of triethylamine, 0.28 g of 1,4-dimethylaminopyridine and 2.16 g of toluenesulfonyl chloride. The resulting mixture was stirred for 2 hours at room temperature. The reaction mixture obtained was poured into 16 ml of water, and the organic layer was extracted The organic layer was washed twice with water, dried over magnesium sulfate, and then concentrated. The concentrate obtained was purified by column chromatography on silica gel, thereby yielding 1.5 g of Exemplified Compound A-(1) as a colorless transparent oily substance.

$^1$H-NMR ($CDCl_3$) δ(ppm): 1.48 (s, 9H), 1.71 (m, 4H), 2.48 (s, 3H), 4.00 (t, 2H), 4.05 (t, 2H), 7.34 (d, 2H), 7.80 (d, 2H)

Synthesis Example 2

Synthesis of Exemplified Compound A-(3)

Exemplified Compound A-(3)

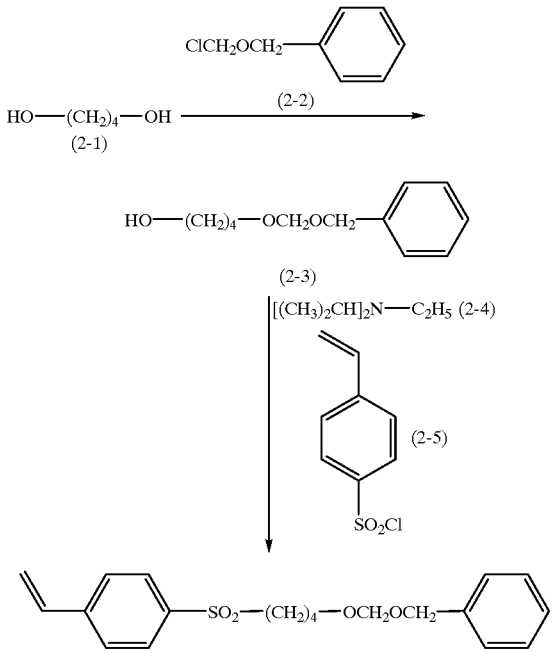

Compound (2-1) in an amount of 9.01 g was admitted in 50 ml of tetrahydrofuran, and thereto an oil dispersion of sodium hydride (4 g, 60% content) was added. After one-hour stirring, 15.66 g of Compound (2—2) was added thereto, and stirred for 3 hours. To the resulting reaction solution, 70 ml of ethyl acetate and 50 ml of water were added, and therefrom an aqueous layer was separated. Further, the reaction solution was washed with water, and the organic layer was dried over anhydrous sodium sulfate, followed by concentration. The oily matter thus obtained was purified by column chromatography on silica gel (eluent: 1:4 by volume mixture of ethyl acetate and hexane), thereby yielding 9.5 g of Compound (2-3).

A 6.3 g portion of the Compound (2-3) obtained above was dissolved in 50 ml of methylene chloride, and thereto 5.17 g of Compound (2-4) and 6.08 g of Compound (2-5) were added. The resulting mixture was stirred for 5 hours. The reaction solution thus obtained was admixed with hexane, and underwent purification as it was. The purification was effected by column chromatography on silica gel (eluent: 1:5 by volume mixture of ethyl acetate and hexane); Thus, 6.2 g of Exemplified Compound A-(3) was obtained in a 55 % yield.

$^1$H-NMR ($CDCl_3$) δ(ppm): 1.65 (4H), 3.55 (2H), 4.1 (2H), 4.6 (2H), 4.75 (2H), 5.5 (1H), 5.9 (1H), 6.8 (1H), 7.35 (5H), 7.6 (2H), 7.9 (2H).

Synthesis Example 3

Synthesis of Exemplified Compound A-(5)

Exemplified Compound A-(5)

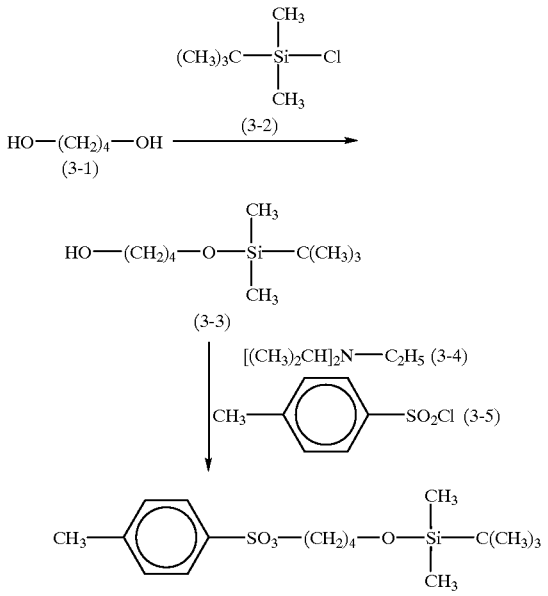

Compound (3-1) in an amount of 15.07 g was admitted in 70 ml of tetrahydrofuran, and thereto an oil dispersion of sodium hydride (4 g, 60% content) was added. After one-hour stirring, 15.66 g of Compound (3-2) was added thereto, and stirred for 3 hours. To the resulting reaction solution, 70 ml of ethyl acetate and 50 ml of water were added, and therefrom an aqueous layer was separated. Further, the reaction solution was washed with water, and the organic layer was dried over anhydrous sodium sulfate, followed by concentration. The oily matter thus obtained was purified by column chromatography on silica gel (eluent: 1:5 by volume mixture of ethyl acetate and hexane), thereby yielding 8.4 g of Compound (3—3).

A 2.04 g portion of the Compound (3—3) obtained above was dissolved in methylene chloride, and thereto 2.6 g of Compound (3-4) and 1.91 g of Compound (3-5) were added. The resulting mixture was stirred for 5 hours. The reaction solution thus obtained was admixed with hexane, and underwent purification as it was. The purification was effected by column chromatography on silica gel feluent: 1:10 by volume mixture of ethyl acetate and hexane). Thus, 2.3 g of Exemplified Compound A-(5) was obtained in a 63 % yield.

$^1$H-NMR ($CDCl_3$) δ(ppm): −0.1 (6H), 0.95 (9H), 1.6 (4H), 2.5 (3H), 3.6 (2H), 4.1 (2H), 7.4 (2H), 7.8 (2H).

EXAMPLE 1

The compounds described below were dissolved in chloroform, coated on a 100 μm-thick polyethylene terephthalate film, and then dried to prepare a transparent heat-sensitive recording sheet. The polystyrene used therein was polystyrene beads (diameter: about 3.2 mm) produced by Wako Pure Chemical Industries, Ltd.

| | |
|---|---|
| Sample 1 | |
| Exemplified Compound A-(1) | 2 mmol/m$^2$ |
| Exemplified Compound C-(1) | 1 mmol/m$^2$ |
| IR dye | 113 mg/m$^2$ |
| Polystyrene | 2.2 g/m$^2$ |
| Sample 2 | |
| Exemplified Compound A-(3) | 2 mmol/m$^2$ |
| Exemplified Compound C-(1) | 1 mmol/m$^2$ |
| IR dye | 113 mg/m$^2$ |
| Polystyrene | 2.2 g/m$^2$ |
| Sample 3 | |
| Exemplified Compound A-(5) | 2 mmol/m$^2$ |
| Exemplified Compound C-(1) | 1 mmol/m$^2$ |
| IR dye | 113 mg/m$^2$ |
| Polystyrene | 2.2 g/m$^2$ |
| Reference Sample 1 | |
| Comparative Compound | 2 mmol/m$^2$ |
| Exemplified Compound C-(1) | 1 mmol/m$^2$ |
| IR dye | 113 mg/m$^2$ |
| Polystyrene | 2.2 g/m$^2$ |
| Reference Sample 2 | |
| Exemplified Compound C-(1) | 1 mmol/m$^2$ |
| IR dye | 113 mg/m$^2$ |
| Polystyrene | 2.2 g/m$^2$ |

IR dye

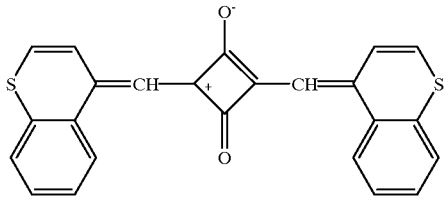

Comparative Compound

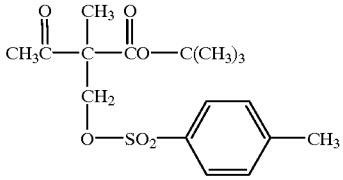

(Compound disclosed in JP-A-8-248561)

<Exposure Condition of Laser for Image Recording>

Laser beams emitted from eight semiconductor laser devices, Spectra Diode Labs No. SDL-2430 (wavelength region: 800–830 nm), were mixed up to form the composite wave having a power of 400 mW, and this composite wave was used as image writing laser.

Each of the Samples prepared above was scanned with the foregoing laser so as to form an image measuring 22 mm×9 mm in size. The exposure conditions adopted therein were as follows: The beam diameter was 160 μm, the laser scanning speed was 1.0 m/sec (at the central part of scanning), the sample feeding speed was 15 mm/sec and the scanning pitch was 8 lines/mm. And the laser energy density on each sample during the aforementioned scanning operation was 2.5 mJ/mm$^2$.

<Comparison of Color Development Rate>

The laser-unexposed and laser-exposed samples prepared from the present Samples 1 to 3 and the Reference Samples 1 to 2 were each heated at 120° C. for 20 seconds to undergo heat development, and examined for developed color density at 365 nm. The color development rate of each sample was calculated from comparison with the theoretical value Exemplified Compound C-(1) shows when it achieves 100% color development. The results obtained are shown in Table 1.

TABLE 1

| | Color Development Rate | |
|---|---|---|
| | not exposed to laser | exposed to laser |
| Sample 1 (invention) | 0% | 56% |
| Sample 2 (invention) | 0% | 87% |
| Sample 3 (invention) | 0% | 92% |
| Reference Sample 1 | 0% | 42% |
| Reference Sample 2 | 0% | 0% |

When subjected to heat development at 120° C. before exposure to the laser beams, every Sample developed no color at all. And the acid generator-free Reference Sample 2 showed no color development even after the exposure to the laser beams. On the other hand, color development ascribed to Exemplified Compound C-(1) was observed in the acid generator-added Samples 1 to 3 and Reference Sample 1 when they were subjected to the heat development after exposure to the laser beams. In particular, it can be seen from Table 1 that the present acid generator-added Samples 1 to 3 achieved great improvement in sensitivity of color development, compared with the known acid generator (Comparative Compound)-added Reference Sample 1.

Further, the haze due to evolution of gas was detected in the Reference Sample 1; besides, it had reddish-brown stain after heat development. On the other hand, the present Samples 1 to 3 had less haze, and no stain was observed therein.

EXAMPLE 2

The present Samples 1 to 3 and the Reference Samples 1 to 2 prepared in Example 1 were stored for 10 days under the temperature of 60° C. and the humidity of 70%, and then subjected to heat development by heating for 20 seconds at 120° C. without undergoing exposure to laser beams. The color development rates examined under such a condition are shown in Table 2.

TABLE 2

| | Color Development Rate |
|---|---|
| Sample 1 (invention) | 0% |
| Sample 2 (invention) | 0% |
| Sample 3 (invention) | 0% |
| Reference Sample 1 | 15% |
| Reference Sample 2 | 0% |

No color development was detected in the present Samples 1 to 3 and the Reference Sample 2, while the Reference Sample 1 caused color development. This shows that the present acid generators were stable, but the comparative compound decomposed under the foregoing storage condition.

EXAMPLE 3

The compounds described below were dissolved in chloroform, coated on a 100 μm-thick polyethylene terephthalate film, and then dried to prepare a transparent sheet. The polystyrene used therein was polystyrene beads (diameter: about 3.2 mm) produced by Wako Pure Chemical Industries, Ltd.

| | |
|---|---|
| Sample 4 | |
| Exemplified Compound A-(58) | 2 mmol/m$^2$ |
| Exemplified Compound C-(50) | 1 mmol/m$^2$ |
| Polystyrene | 2.2 g/m$^2$ |
| Reference Sample 3 | |
| Comparative Compound | 2 mmol/m$^2$ |
| Exemplified Compound C-(1) | 1 mmol/m$^2$ |
| IR dye | 113 mg/m$^2$ |
| Polystyrene | 2.2 g/m$^2$ |
| Reference Sample 2 | |
| Photoacid generator AC-(7) | 2 mmol/m$^2$ |
| Exemplified Compound C-(50) | 1 mmol/m$^2$ |
| Polystyrene | 2.2 g/m$^2$ |

With regard to Sample 4 and Reference Sample 3, metal halide lamp (80 W/cm) was irradiated so that the energy corresponding to the absorption wavelength region of the acid generator becomes about 30 mj/cm$^2$. As a result, Sample 4 and Reference Sample 3 each show almost 100% color development.

On the other hand, when Sample 4 and Reference Sample 3 were stored at the dark place in the storage conditions of 60° C., 70% RH and 7d, complete color development was shown for Reference Sample 3 but no color development was shown for Sample 4 and thus it is clear that Sample 4 was excellent in wet heat stability.

In accordance with the present invention, an image recording medium having both high activity and satisfactory storability can be obtained by incorporating therein a novel acid generator of intramolecular nucleophilic substitution type, which is stable upon storage but generates an acid by the action of heat or an acid. Furthermore, an image recording medium having both excellent storability and high acitivity can be obtained by incorporating therein an acid generator of intramolecular nucleophilic substitution type, which generates an acid by the action of light.

While the invention has been described in detail and with reference to specific embodiments thereof, it will be apparent to one skilled in the art that various changes and modifications can be made therein without departing from the spirit and scope thereof.

What is claimed is:

1. An image recording medium comprising a compound that has at least one substituent group removable by the action of heat, an acid or light and can produce an acid by an intramolecular nucleophilic substitution subsequent to the removal of the substituent group.

2. The image recording medium as in claim 1, wherein said compound is a compound represented by the following formula (1):

$$P—X—L—C(R^1)(R^2)—OA \quad (1)$$

wherein P represents a substituent group removable by the action of heat, an acid or light; X represents O, S, $N(R^3)$ or $C(R^4)(R^5)$; $R^3$ is a hydrogen atom or a group capable of substituting therefor; $R^4$ and $R^5$, which may be the same or different, are each a hydrogen atom or a group capable of substituting therefor; L represents a linkage group; $R^1$ and $R^2$, which may be the same or different, are each a hydrogen atom or a group capable of substituting therefor; and OA represents the residue of an acid represented by HOA.

3. The image recording medium as in claim 1, further comprising a compound that can produce a change in the absorption region of 360–900 nm through an intramolecular or intermolecular reaction caused herein by the action of the acid.

4. The image recording medium as in claim 1, further comprising a compound that can generate an acid by the action of light or heat.

5. The image recording medium as in claim 1, further comprising an infrared absorbing substance.

* * * * *